US009905071B2

(12) United States Patent
Muta et al.

(10) Patent No.: US 9,905,071 B2
(45) Date of Patent: Feb. 27, 2018

(54) PAPER CURRENCY HANDLING DEVICE

(71) Applicant: Hitachi-Omron Terminal Solutions, Corp., Shinagawa-ku, Tokyo (JP)

(72) Inventors: Kentaro Muta, Tokyo (JP); Takashi Yanase, Tokyo (JP); Genta Ogawa, Tokyo (JP)

(73) Assignee: HITACHI-OMRON TERMINAL SOLUTIONS, CORP., Tokyo (JP)

( * ) Notice: Subject to any disclaimer, the term of this patent is extended or adjusted under 35 U.S.C. 154(b) by 0 days.

(21) Appl. No.: 15/304,994

(22) PCT Filed: May 25, 2015

(86) PCT No.: PCT/JP2015/064926
§ 371 (c)(1),
(2) Date: Oct. 18, 2016

(87) PCT Pub. No.: WO2015/198768
PCT Pub. Date: Dec. 30, 2015

(65) Prior Publication Data

US 2017/0140598 A1 May 18, 2017

(30) Foreign Application Priority Data

Jun. 27, 2014 (JP) ..... 2014-132486

(51) Int. Cl.
*G07F 7/04* (2006.01)
*G07D 11/00* (2006.01)
*B65H 3/06* (2006.01)

(52) U.S. Cl.
CPC ..... *G07D 11/0006* (2013.01); *B65H 3/063* (2013.01); *G07D 11/0024* (2013.01)

(58) Field of Classification Search
CPC ..... G07D 11/0006; G07D 11/0024; G07D 11/0018; G07F 19/00; G07F 19/205; B65H 3/063
(Continued)

(56) References Cited

U.S. PATENT DOCUMENTS 6,186,490 B1 * 2/2001 Sugiura ..... B65H 3/0638 271/10.09
2003/0116622 A1 * 6/2003 Suttie ..... G07D 11/0036 235/379
(Continued)

FOREIGN PATENT DOCUMENTS

JP 9-267931 A 10/1997
JP 2006-209580 A 8/2006
(Continued)

OTHER PUBLICATIONS

Japanese Office Action issued in corresponding application No. 2014-132486 dated Jun. 29, 2017.

*Primary Examiner* — Mark J Beauchaine
(74) *Attorney, Agent, or Firm* — Foley & Lardner LLP

(57) ABSTRACT

In order to improve the ability to feed paper currency from a deposit unit and to reduce the height of the device, this paper currency handling device (100) has a paper currency recognition unit (170) and a paper currency storage unit (200) (which does not include a deposit unit (120) and a withdrawal unit (140)) accommodated within a chassis section (112) of a vault (110), so that deposited paper currency is transported to the paper currency storage unit (200) and withdrawn paper currency is transported from the paper currency storage unit (200) as the paper currency passes through the chassis section (112). When the paper currency (B) is fed to a feed path unit (124) connecting the deposit unit (120) and an upstream deposit path (181), the vanes (129) of impellers (128) make contact with the paper
(Continued)

currency (B) retained in the deposit unit (120), with the contact being on the feed path unit (124) side.

8 Claims, 17 Drawing Sheets

(58) Field of Classification Search
USPC ..... 271/10.11, 21, 23
See application file for complete search history.

(56) References Cited

U.S. PATENT DOCUMENTS

| | | | | |
|---|---|---|---|---|
| 2008/0230981 | A1* | 9/2008 | Iwami | B65H 1/025 271/153 |
| 2009/0322015 | A1* | 12/2009 | Mantovan | G07D 11/0084 271/113 |
| 2010/0244356 | A1* | 9/2010 | Sato | G07D 11/0084 271/3.14 |

FOREIGN PATENT DOCUMENTS

| | | | |
|---|---|---|---|
| JP | 2009-263139 | A | 11/2009 |
| JP | 2010-143767 | A | 7/2010 |
| JP | 2012-108817 | A | 6/2012 |
| JP | 2014-99196 | A | 5/2014 |

* cited by examiner

PAPER CURRENCY HANDLING DEVICE

TECHNICAL FIELD

The present invention relates to a paper currency handling device.

BACKGROUND ART

A paper currency handling device is mounted on an automated teller machine (Automated Teller Machine; hereinafter simply referred to also as ATM) or the like and is widely spread. In an ATM, paper currency per se is handled, and therefore, there is proposed a method of accommodating respective apparatus excluding a paper currency depositing unit and a paper currency withdrawing unit and achieving further downsizing of the apparatus in order to ensure security (Patent Literature 1).

CITATION LIST

Patent Literature

Patent Literature 1: Japanese Unexamined Patent Application Publication No. 2012-108817

SUMMARY OF INVENTION

Technical Problem

In recent years, it is becoming normal that a clerk at a window of a bank casts paper currency deposited from a customer to the paper currency depositing unit and delivers a withdrawn paper currency to the customer by using ATM per se. In such a mode of use, the number of sheets of paper currency deposited from a customer is various, and depending of cases, it may be sufficient to cast a single sheet or several sheets of paper currency to the paper currency depositing unit. When the number of sheets of cast paper currency is large, a folding mark, bending or the like of the paper currency is corrected by a self weight of a large number of sheets of paper currency cast to the paper currency depositing unit, and therefore, not so much trouble happens in feeding the paper currency from the paper currency depositing unit. However, when the number of sheets of cast paper currency is small, the correction of the folding mark or bending of the paper currency by the self weight is not progressed, and there is a concern that the paper currency is brought into contact with a wall face at a surrounding of a paper currency feeding port of a paper currency depositing unit and the paper currency feeding is stopped. Also, when a large up and down motion of the arm is needed in casting the paper currency to the paper currency depositing unit, there is a concern of applying a large physical load to the clerk of the window who casts the paper currency. Therefore, it is requested to improve an ability of feeding the paper currency from the paper currency depositing unit, or further compact formation of the apparatus in a height direction is requested.

Solution to Problem

The present invention has been carried out for resolving at least a portion of the problem described above, and can be realized as the following mode.

According to a mode of the present invention, there is provided a paper currency handling device comprising:

a paper currency depositing unit for receiving paper currency depositing of a paper currency;

a paper currency withdrawing unit for withdrawing the paper currency;

a discriminating unit for discriminating a kind of the deposited and withdrawn paper currency;

a storing unit for storing the paper currency;

a vault having a chassis section for accommodating the storing unit and the discriminating unit and partitioning the paper currency depositing unit and the paper currency withdrawing unit from the storing unit and the discriminating unit; and a transporting unit connecting the paper currency depositing unit and the paper currency withdrawing unit to the discriminating unit and the storing unit and transporting the paper currency;

wherein the paper currency depositing unit includes a feeding unit for connecting a paper currency holding unit piling and holding the received paper currency to the transporting unit and feeding the paper currency held by the paper currency holding unit to the transporting unit, and a vane drive member for driving a vane capable of being brought into contact with the paper currency held by the paper currency holding unit; and wherein in feeding the paper currency from the feeding unit, the vane is brought into contact with the paper currency held by the paper currency holding unit by driving the vane by the vane drive member.

Further, according to another embodiment of the present invention, there is provided a paper currency handling device comprising:

a paper currency depositing unit for receiving depositing of a paper currency;

a paper currency withdrawing unit for withdrawing the paper currency;

a discriminating unit for discriminating a kind of the deposited and withdrawn paper currency;

a storing unit for storing the paper currency;

a vault having a chassis section for accommodating the storing unit and the discriminating unit and partitioning the paper currency depositing unit and the paper currency withdrawing unit from the storing unit and the discriminating unit; and a transporting unit connecting the paper currency depositing unit and the paper currency withdrawing unit to the discriminating unit and the storing unit, and transporting the paper currency;

wherein the transporting unit includes:

a main transporting unit including a first main transportation path passing the discriminating unit, and a second transportation path reaching the storing unit by being folded back from a path downstream of the first main transportation path, and transporting the paper currency in two directions at the first main transportation path and the second transportation path;

a first auxiliary transporting unit connected to the first main transporting path at a path upstream by passing the chassis section from the paper currency depositing unit for transporting the paper currency from the paper currency depositing unit; and a second auxiliary transporting path unit connected to the first transportation path at a first upstream, reaching the paper currency withdrawing unit by passing the chassis section for transporting the paper currency to the paper currency withdrawing unit;

wherein the second auxiliary transporting unit transports the paper currency at a path formed via a plurality of fold backs between the first main transportation path and the second main transportation path.

Advantageous Effects of Invention

According to the paper currency handling devices of the modes described above, security is ensured by accommodating the respective apparatus excluding the paper currency depositing unit and the paper currency withdrawing unit in the vault and achieving paper currency transportation by passing the chassis section of the vault. Furthermore, according to the paper currency handling device of the former mode, also with regard to a paper currency the feeding of which is stopped since a fold mark or paper currency bending is attached, the paper currency changes its attitude from a stationary attitude by bringing the vane of the vane drive member into contact with the paper currency, and therefore, there is brought about a state of enabling paper currency feeding, and the ability of feeding the paper currency from the paper currency depositing unit can be improved. Further, according to the paper currency handling device of the latter mode, at least an apparatus height dimension can be shortened by an amount of including plural fold back paths in the second auxiliary transporting unit reaching the paper currency depositing unit by passing the chassis section from a path upstream of the first transportation path including the discriminating unit, and a path length of the paper currency transportation path in the second auxiliary transporting unit can be ensured.

A problem other than those described above, as well as a configuration and an effect resolving the problem will become apparent by explaining the following embodiments.

DESCRIPTION OF EMBODIMENTS

An explanation will be given of embodiments of the present invention based on drawings as follows. The paper currency handling device 100 according to the present invention is mounted on an ATM installed at a bank window, and apparatus operation, paper currency casting or the like in accordance with depositing and withdrawing of paper currency is assumed to be carried out by a window clerk.

Figure 1:
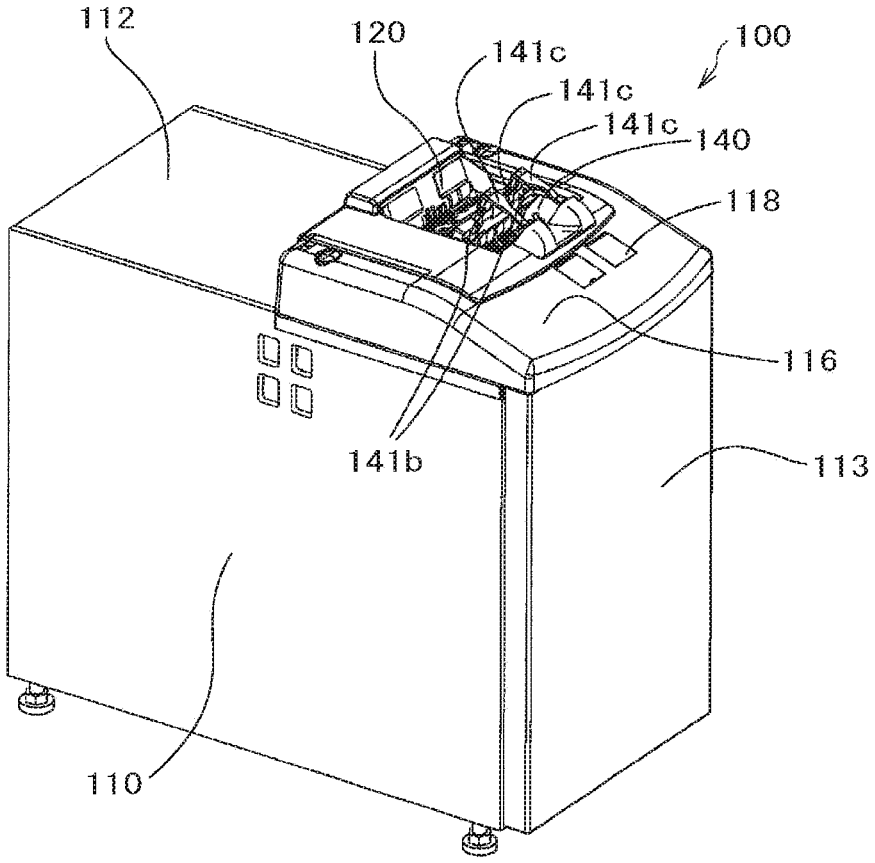
FIG. 1 is an explanatory view showing a general outlook of a paper currency handling device 100 according to the present embodiment.
Figure 2:
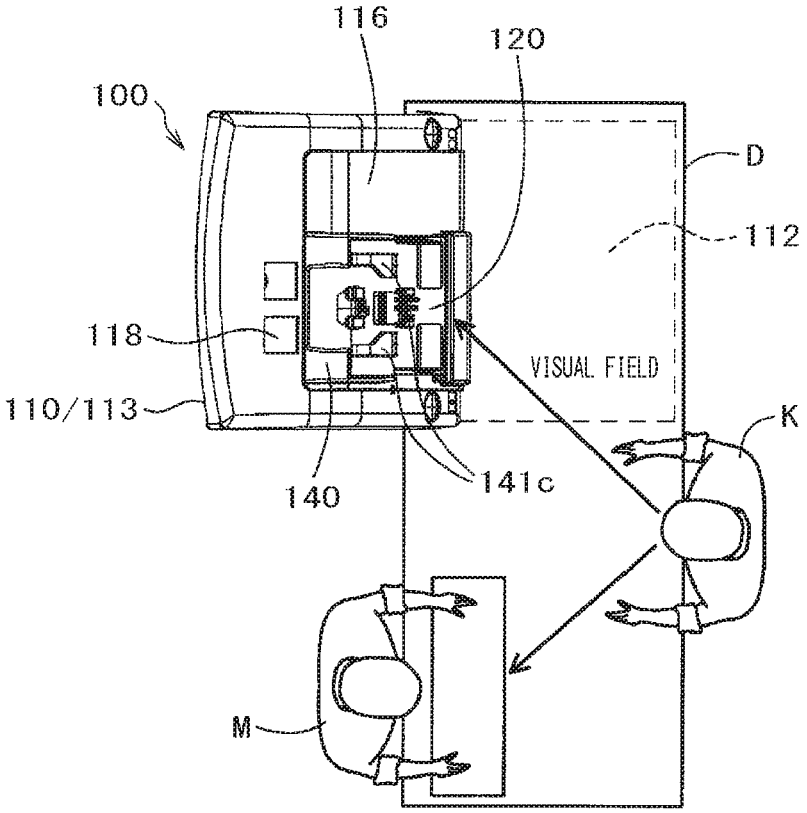
FIG. 2 is an explanatory view generally showing a positional relationship for a clerk M of a window and a customer K by viewing the paper currency handling device 100 in a plane view.
Figure 3:
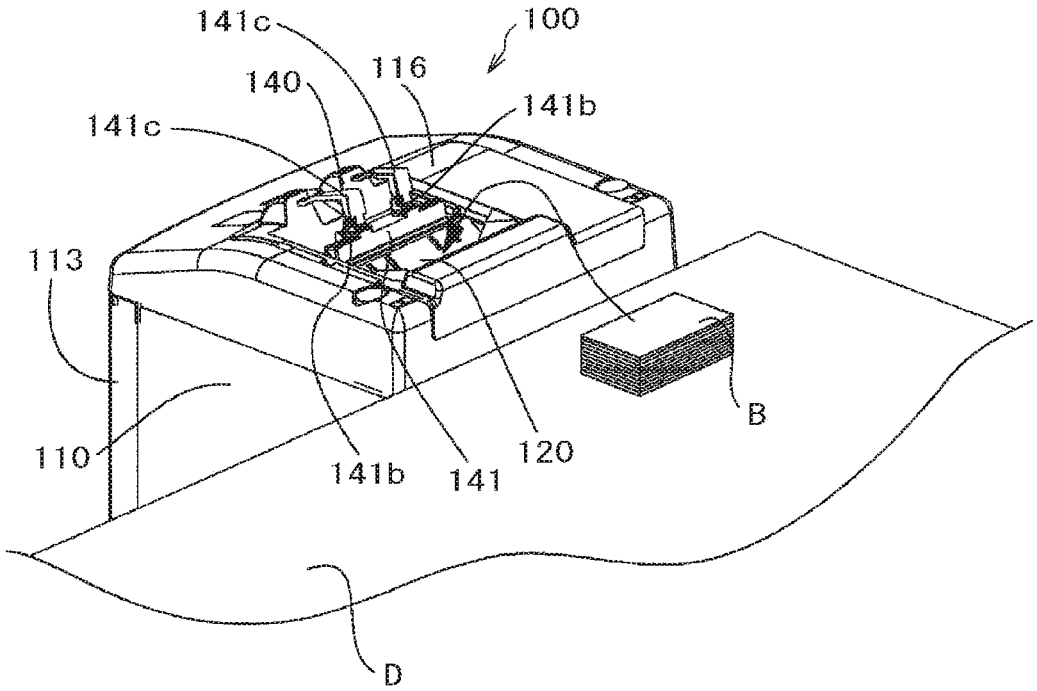
FIG. 3 is an explanatory view generally viewing an upper area of the paper currency handling device 100 in a perspective view.

A: Total Configuration;

FIG. 1 is an explanatory view showing a general outlook of the paper currency handling device 100 according to the present invention, FIG. 2 is an explanatory view generally showing a positional relationship for a window clerk M and a customer K by viewing the paper currency handling device 100 in a plane view, and FIG. 3 is an explanatory view generally showing an upper area of the paper currency handling device 100 in a perspective view. As shown in FIG. 1, the paper currency handling device 100 is classified to up and down in its outlook, a lower area is made to be a vault 110, and an upper area above a chassis section 112 included by the vault is made to be a paper currency depositing and withdrawing mechanism unit 116. The chassis section 112 is formed by a metallic steel plate, includes a vault door 113 made of metal which is openable/closable and lockable, and configures the vault 110 along with the vault door 113. The paper currency handling device 100 ensures security for a paper currency storing unit 200 by accommodating a paper currency discriminating unit 170, a paper currency storing unit 120 described later in the chassis section 112 closed by the vault door 113.

The paper currency depositing and withdrawing mechanism unit 116 includes an operator panel 118 operated by the window clerk, and further includes a paper currency depositing unit 120 and a paper currency withdrawing unit 140 described later contiguously from this side of a paper face to a back side of the paper face in FIG. 1, that is, from a front face side of the apparatus over to a rear face side. Further, as shown in FIG. 2, according to the paper currency handling device 100, a rear face of the apparatus is covered by a customer receiving table D, and the paper currency depositing unit 120 and the paper currency withdrawing unit 140 of the paper currency depositing and withdrawing mechanism unit 116 are made to be visually recognizable for the customer K. A behavior of visual recognition by the customer K is shown in FIG. 3, and the paper currency handling device 100 includes the paper currency depositing unit 120 and the paper currency withdrawing unit 140 in this order from a side of the customer K contiguous to the paper currency depositing and withdrawing mechanism unit 116. As shown in FIG. 2, the window clerk M faces the customer K by interposing the customer receiving table D, carries out casting of the paper currency B deposited from the customer K to the paper currency depositing unit 120 and delivery of the paper currency withdrawn to the paper currency withdrawing unit 140 to the customer K other than a prescribed operation of the operator panel 118. A detailed description will be given of a configuration of the paper currency handling device 100 as follows.

Figure 4:
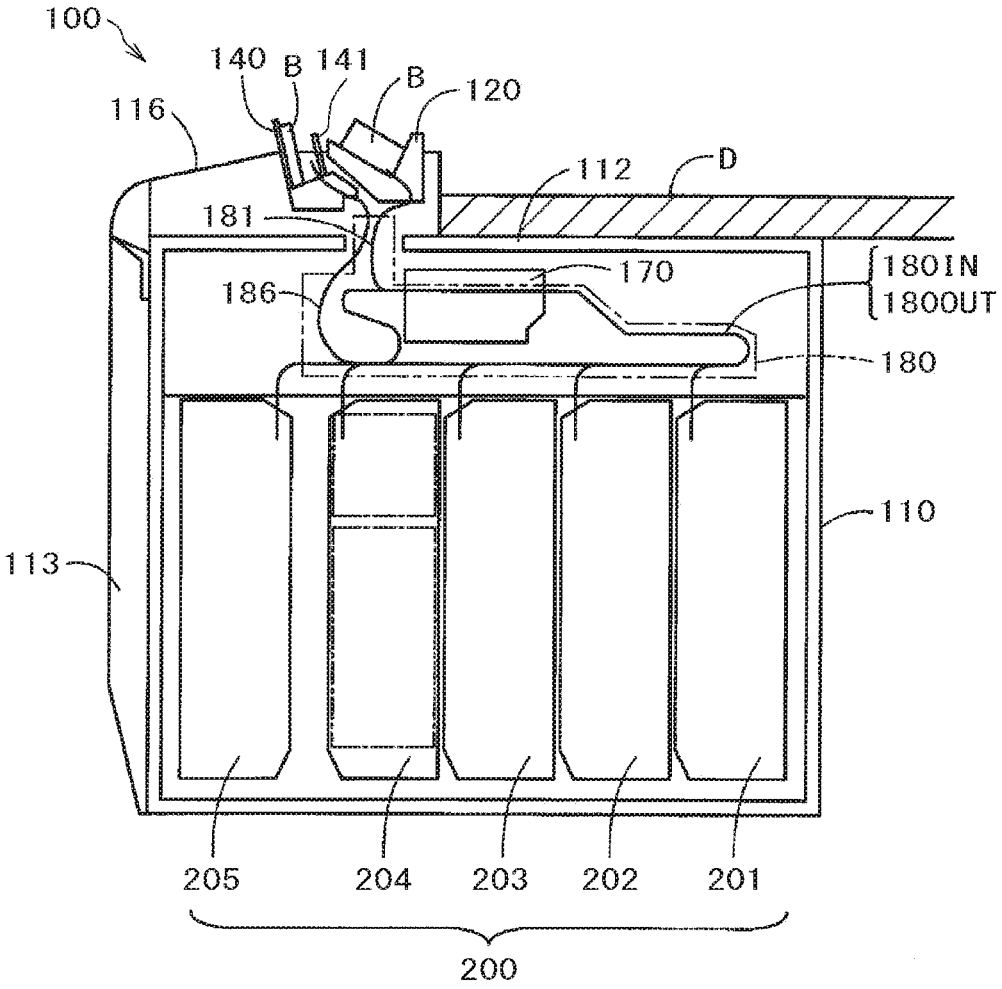
FIG. 4 is an explanatory view generally showing an inner configuration of the paper currency handling device 100 and a paper currency transportation path in a sectional view.

FIG. 4 is an explanatory view generally showing an inner configuration and a paper currency transportation path of the paper currency handling device 100 in a sectional view. As illustrated, according to the paper currency handling device 100, the paper currency depositing and withdrawing mechanism unit 116 described already includes the paper currency depositing unit 120 receiving a deposition of the paper currency B and the paper currency withdrawing unit 140 of depositing the paper currency B to arrange contiguous to each other, and the chassis section 112 of the vault 110 includes the paper currency discriminating unit 170, a transportation mechanism unit 180, and the paper currency storing unit 200 to accommodate. The paper currency discriminating unit 170 and the paper currency storing unit 200 accommodated in the vault 110 in this way are partitioned from the paper currency depositing unit 120 and the paper currency withdrawing unit 140 of the paper currency depositing and withdrawing mechanism unit 116 by the chassis section 112, and in the chassis section 112, the paper currency discriminating unit 170 is disposed on an upper side of the paper currency storing unit 200.

The paper currency depositing unit 120 is arranged on a side of the paper currency discriminating unit 170 of the paper currency withdrawing unit 140, and the paper currency withdrawing unit 140 arranged contiguously to the paper currency depositing unit 120 includes a wall portion 141 on a side of the paper currency depositing unit 120. The wall portion 141 covers an inner portion of the paper currency withdrawing unit 140 by a side of the paper currency depositing unit 120 and includes a lid 141*c* by interposing the lid 141*c* at a base portion 141*b* at an upper end thereof. The lid 141*c* is made to be openable and closable to cover an upper end of an opening of the paper currency withdrawing unit 140, and prevents jumping out of a withdrawn paper currency transported to the paper currency withdrawing unit 140. The wall portion 141 is extended only to an upper end of an opening of the paper currency withdrawing unit 120, and its width is narrowed even at the lid 141*c*. Therefore, the wall portion 141 and the lid 141*c* do not obstruct the eyes of the customer K (refer to FIG. 2) interposing the customer receiving table D when the customer K views the paper currency withdrawing unit 140 from a side of the paper currency depositing unit 120.

The paper currency discriminating unit 170 forms a partial path of a first main transportation path 183 (refer to FIG. 8) described later formed by the transportation mechanism unit 180. In other words, the first main transportation path passes the paper currency discriminating unit 170. Further, the paper currency discriminating unit 170 discriminates the described number, the paper currency authenticity, a destructed situation (rejection requirement) or the like other than the paper currency kind classification of the paper currency B concerning the paper currency B transported on the first main transportation path 183 in a procedure of paper currency depositing and withdrawing. The paper currency discrimination by the paper currency discriminating unit 170 can be carried out by utilizing various information of image data obtained by scanning the paper currency B, an irregular shape of the surface of the paper currency B, a magnetic property, an optical property for an ultraviolet ray or the like. A discriminating result of the paper currency discriminating unit 170 is outputted to a control unit 300 described later, and is used for determining a cassette of the paper currency transportation destination, and a reject paper currency transportation or the like.

The transportation mechanism unit 180 forms the paper currency depositing path 180IN and the paper currency withdrawing path 180OUT from the paper currency depositing unit 120 and the paper currency withdrawing unit 140 over to the paper currency storing unit 200. Although details of the two paths will be described later, as shown in FIG. 4, the paper currency depositing path 180IN includes an upstream side paper currency depositing path 181 reaching the paper currency discriminating unit 170 from the paper currency depositing unit 120. The paper currency withdrawing path 180OUT includes the downstream side paper currency withdrawing path 186 reaching the paper currency withdrawing unit 140 from the paper currency discriminating unit 170. The transportation mechanism unit 180 including these paths transport paper currency by connecting the paper currency depositing unit 120 and the paper currency withdrawing unit 140 with the paper currency discriminating unit 170 and the paper currency storing unit 200 at the paper currency depositing and withdrawing path described above. The paper currency storing unit 200 includes paper currency storing cassettes 201 through 205, and stores the paper currency B as described later to respective cassettes.

Figure 5:
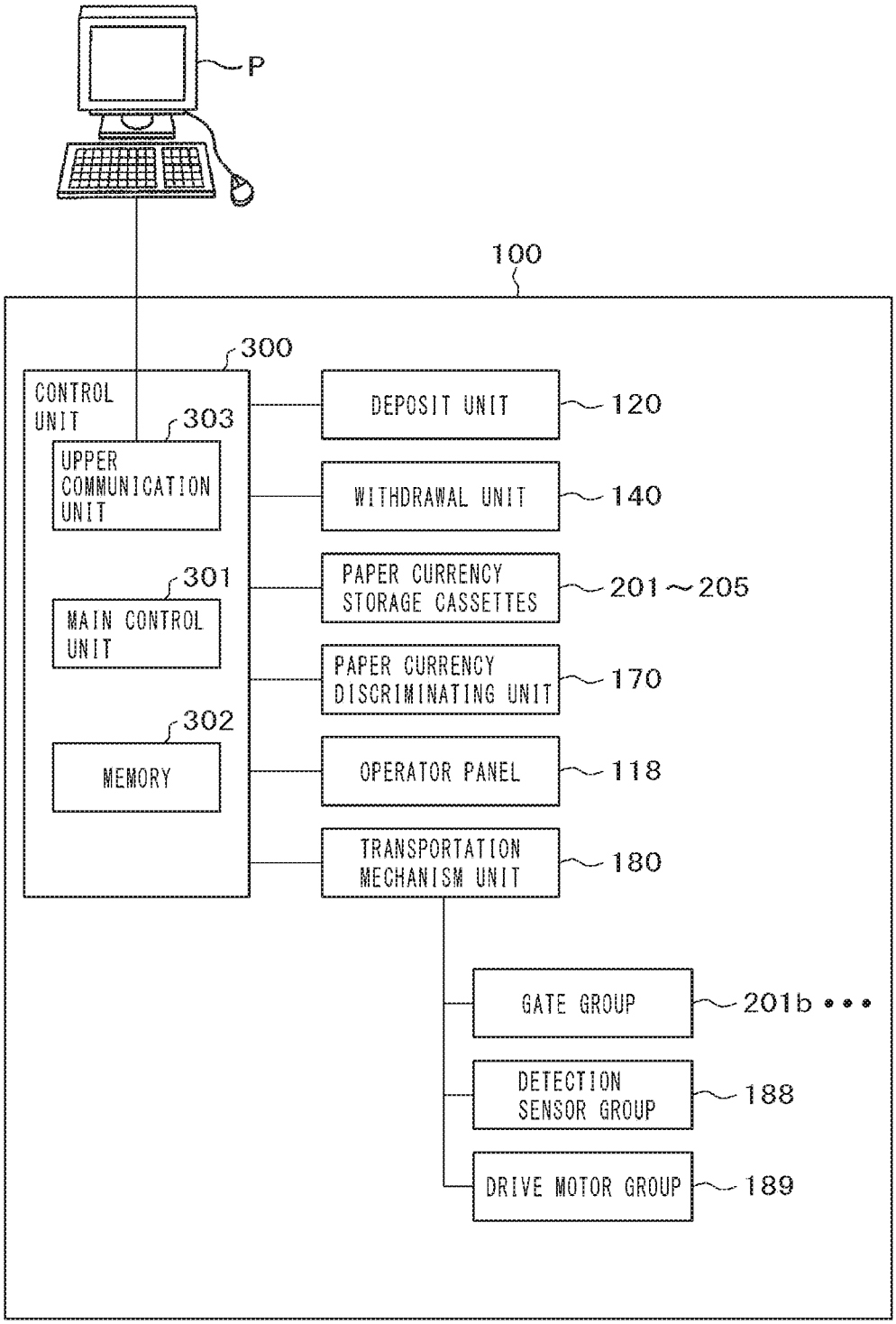
FIG. 5 is an explanatory view showing a control block of the paper currency handling device 100.

B: Electric Configuration;

FIG. 5 is an explanatory view showing a control block of the paper currency handling device 100. The paper currency handling device 100 includes the paper currency depositing unit 120, the paper currency withdrawing unit 140, the paper currency storing cassettes 201 through 205 of the paper currency storing unit 200, the paper currency discriminating unit 170, the operator panel 118, the transportation mechanism unit 180, and the control unit 300 as electric function blocks. As described later, the transportation mechanism unit 180 includes a gate group starting from a gate 201*b* for each cassette, a detection sensor group of plural detection sensors 188 installed at the paper currency transportation path, and a drive motor group of plural motors 189 taking the task of the transportation. The control unit 300 includes a main control unit 301, a memory 302, and an upper communication unit 303 capable of communicating with an operation terminal P. The main control unit 301 is configured by a microprocessor mainly for control. The main control unit 301 controls to drive the drive apparatus related to the feeding and transportation included in the paper currency depositing unit 120 described later or the like and a gate group and a drive motor group of the transportation mechanism unit 180 in accordance with depositing, withdrawing and transportation of paper currency. A detection sensor 188 included in the detection sensor group detects a paper currency transportation state at the paper currency depositing path 180IN and the paper currency withdrawing path 180OUT descried later, detects presence or absence of the paper currency at the paper currency depositing unit 120 or the paper currency withdrawing unit 140, detects numbers of sheets of the paper currency storing cassettes 201 through 205, and outputs detection signals thereof to the control unit 300.

Figure 6:
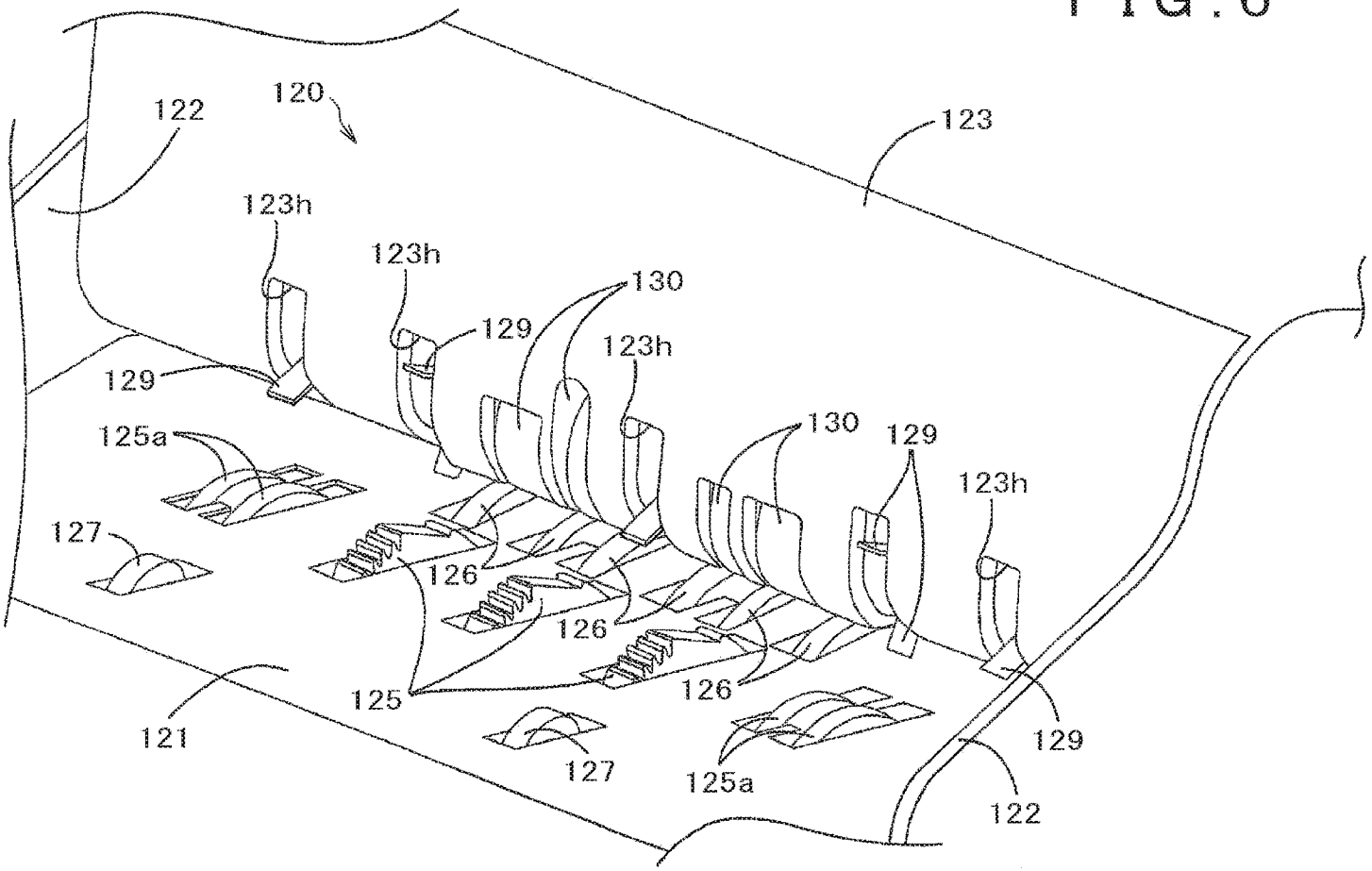
FIG. 6 is an explanatory view generally showing a roller configuration related to paper currency feeding in a deposit unit 120 in a perspective view.
Figure 7:
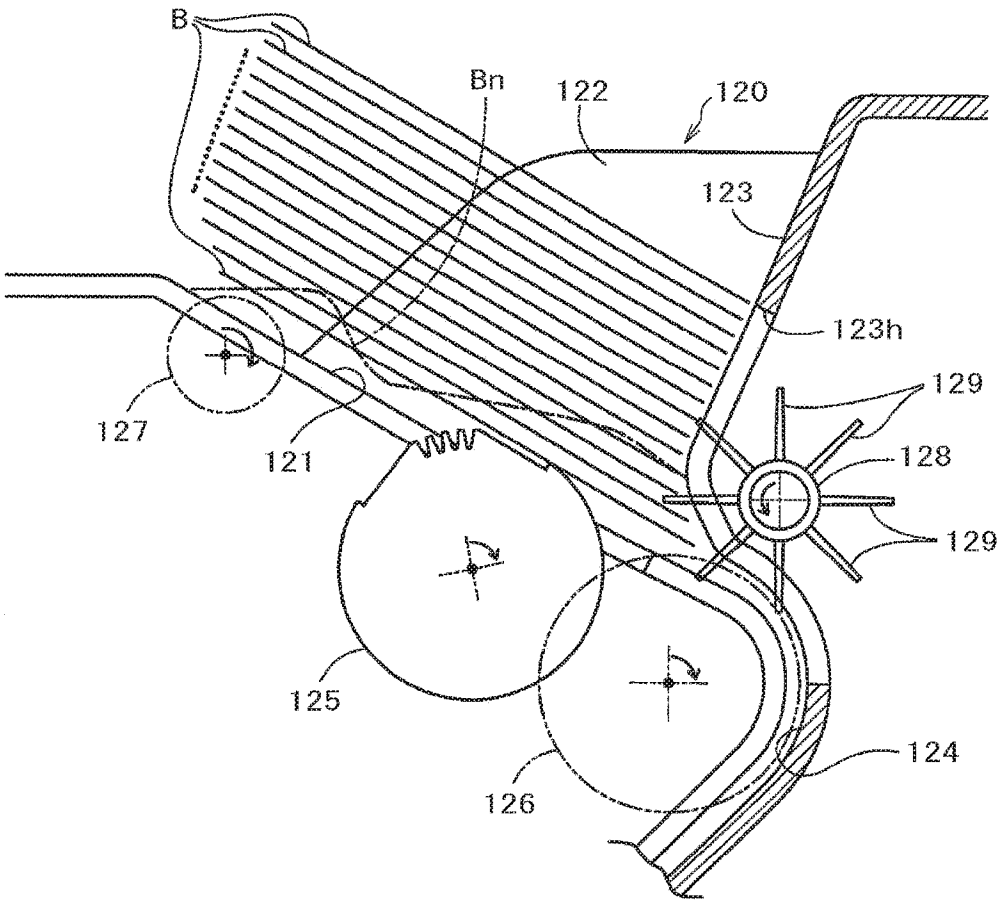
FIG. 7 is an explanatory view generally viewing a major roller configuration related to paper currency feeding from the paper currency depositing unit 120 to an upstream side depositing path 181 in a sectional view.

C: Paper Currency Feeding Configuration;

FIG. 6 is an explanatory view generally showing a roller configuration related to the paper currency feeding at the paper currency depositing unit 120 in the perspective view, and FIG. 7 is an explanatory view generally showing a major roller configuration related to the paper currency feeding from the paper currency depositing unit 120 to the upstream side paper currency depositing path 181 in a sectional view.

As illustrated, the paper currency depositing unit 120 includes an opening recess portion 121 an upper end side of which is opened. The opening recess portion 121 piles up a received paper currency B at an inclined bottom face wall to hold, and surrounds the paper currency B by a side wall 122 at the surrounding of the recess portion and a paper currency end portion side wall 123. Further, the paper currency depositing unit 120 configures a feeding path portion 124 by a lower end of the paper currency end portion side wall 123 and the inclined bottom face wall of the opening recess portion 121, and connects the opening recess portion 121 to the upstream side paper currency depositing path 181 (refer to FIG. 4) by the feeding path portion 124 at its bottom portion corner. The paper currency depositing unit 120 includes plural paper currency feeding first rollers 125, plural paper currency feeding second rollers 126, and plural paper currency feeding third rollers 127 respectively at an inclined bottom face wall of the opening recess portion 121. The respective feeding rollers are respectively rotated by being projected from the roller peripheral wall from an inclined bottom face of the opening recess portion 121. The paper currency depositing unit 120 feeds the paper currency B piled up at the opening recess portion 121 from the paper currency B on a pile lower side sheet by sheet to the feeding path portion 124, and therefore, the upstream side paper currency depositing path 181 (refer to FIG. 4) connected thereto by driving to rotate the respective feeding rollers described above in arrow mark directions of the drawings described in FIG. 7. The paper currency feeding first roller 125 feeds the paper currency B piled up at the opening recess portion 121 to the feeding path portion 124 from the paper currency B on a pile lower side while moving up and down, since a radius of a partial outer periphery circular arc is made to be larger than a radius of other circular arc portion. Further, as shown in FIG. 6, the paper currency depositing unit 120 includes a paper currency feeding first auxiliary roller 125*a* in a shape of a complete round circle in line with the paper currency feeding first roller 125.

Further, the paper currency depositing unit 120 includes an impeller 128 at a lower end side of the paper currency end portion side wall 123. As shown in FIG. 6, the plural impellers 128 are arranged at the paper currency end portion side wall 123, and project front ends of vanes 129 from openings 123*h* of the paper currency end portion side wall 123 to an inner portion of the opening recess portion 121. The vane 129 projected in this way is allowed to be able to contact with the paper currency B held at the opening recess portion 121. The impeller 128 is driven to rotate by receiving a control of the control unit 300 described later when the paper currency B is fed out from the paper currency depositing unit 120, and brings the plural vanes 129 in contact with the paper currency B on the lower side piled up at the opening recess portion 121, in details, an end portion side of the paper currency B. According to the present embodiment, the impeller 128 is rotated in an arrow mark direction of the drawing described in FIG. 7, and therefore, the vane 129 is brought into contact with an end portion of the paper currency on the lower side piled up at the opening recess portion 121 from an upper side over to a lower side of the pile of the paper currency. Therefore, the paper currency B piled up at the opening recess portion 121 are fed to the feeding path portion 124 successively, sheet by sheet from the paper currency B on the pile lower side by rotating the feed rollers starting from the paper currency feeding first roller 125 by the contact of the end portion of the vane 129. When the paper currency is fed, it is possible that a number of the paper currency B received at the opening recess portion 121 is a single sheet, or one sheet of the paper currency B at the topmost portion of the piled paper currency remains. When the single sheet of the paper currency B or plural sheets of the paper currency B is (are) assumedly bent as illustrated and is (are) not brought into contact with the first and second paper currency feeding rollers, it is possible that the paper currency(s) B take(s) a stationary attitude by bringing a front end(s) of the paper currency(s) into contact with an outer surface of the paper currency end portion side wall 123 to remain at the opening recess portion 121. According to the paper currency depositing unit 120 of the present embodiment, the vane 129 is brought into contact with the paper currency end portion of the paper currency B in the stationary attitude, and therefore, the paper currency B changes its attitude from the stationary attitude, and the paper currency end portion is pressed to a side of the bottom portion corner of the opening recess portion 121. Thereby, the paper currency B which is not brought into contact with the feed roller since the paper currency B has been brought into the stationary state, it is brought into contact with either of the paper currency feeding first roller 125 and the paper currency feeding second roller 126, or both of them.

Figure 8:
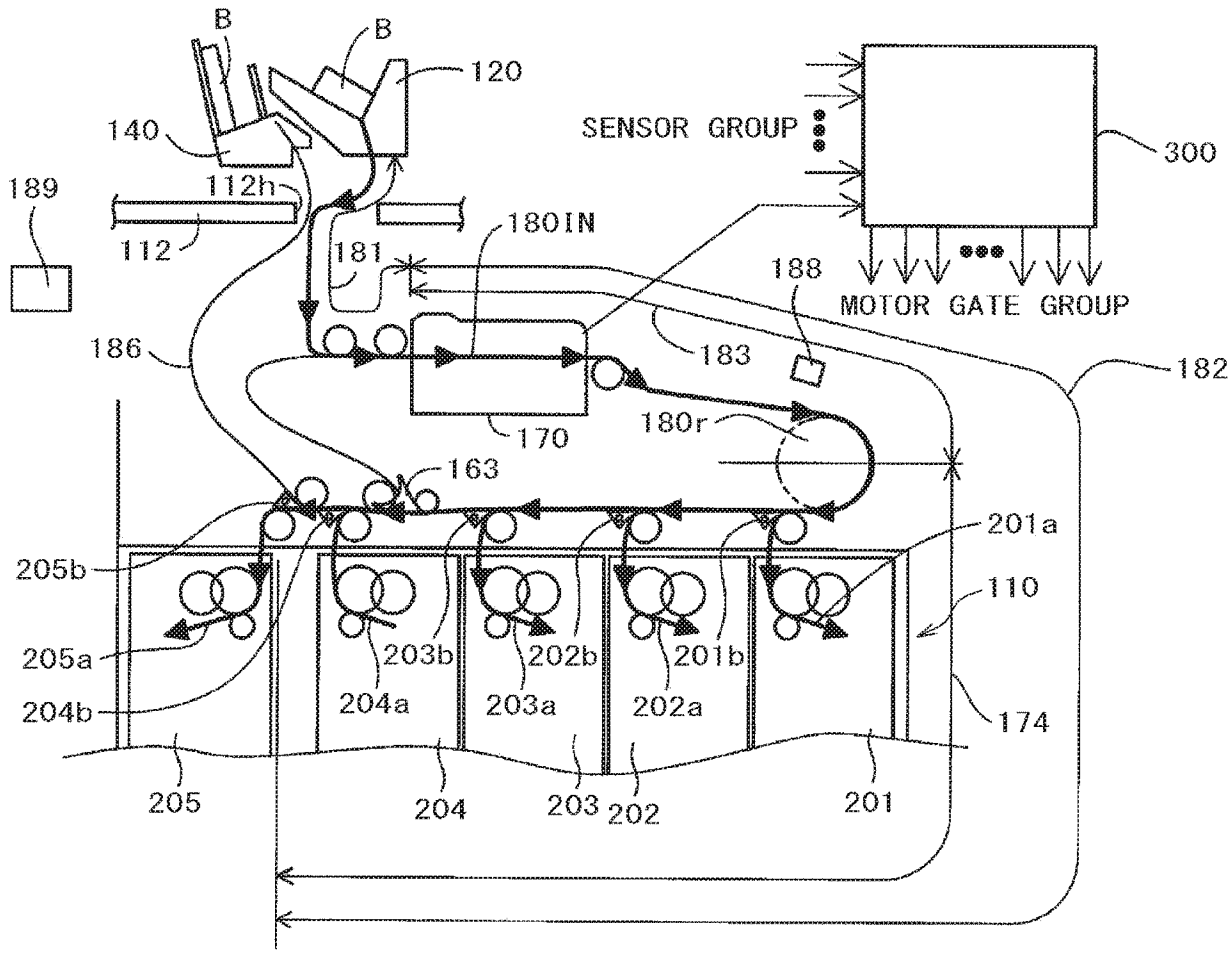
FIG. 8 is an explanatory view generally explaining a path configuration related to a depositing transportation in a configuration of a paper currency transportation path.
Figure 9:
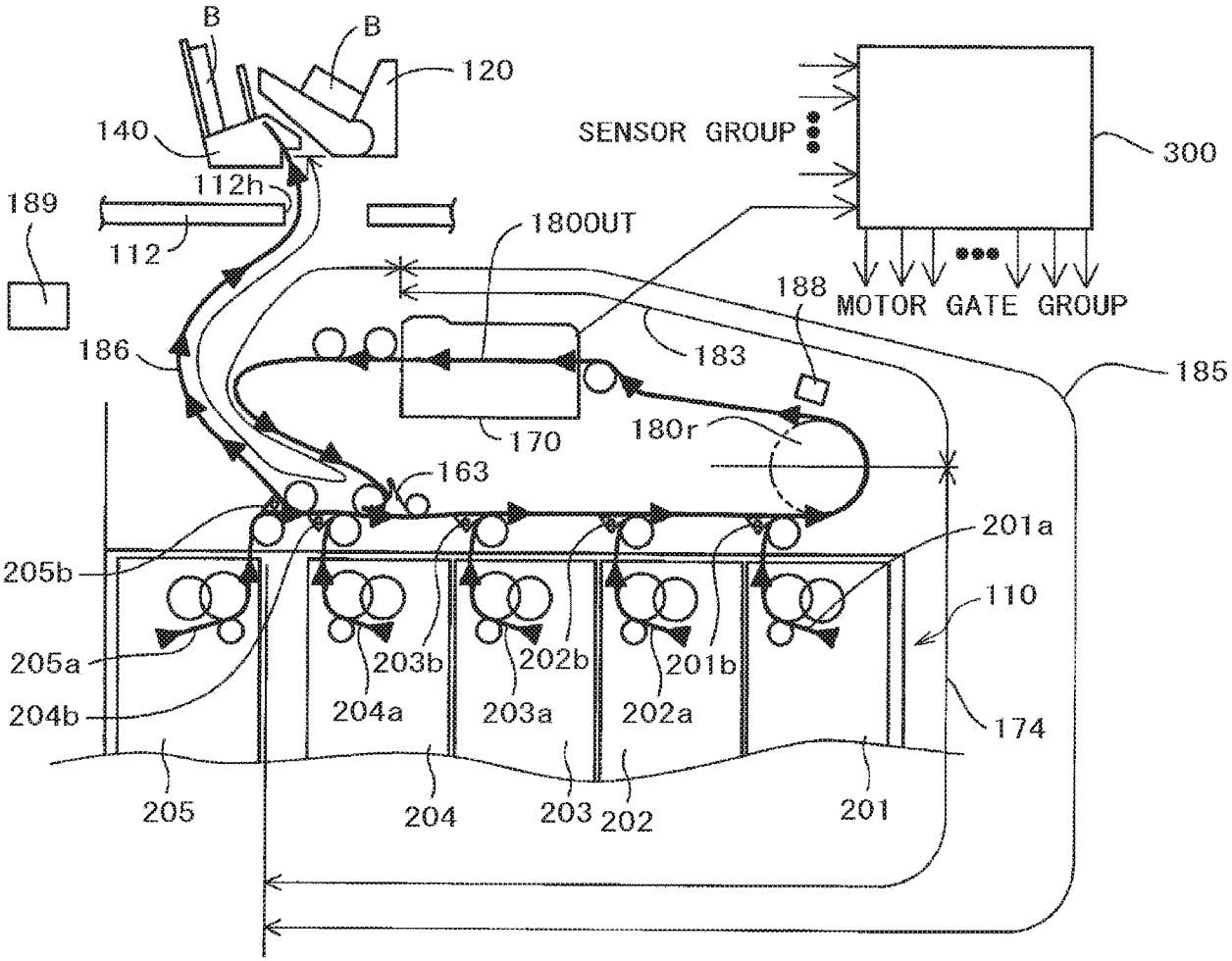
FIG. 9 is an explanatory view generally explaining a path configuration related to withdrawing transportation in a configuration of the paper currency transportation.

D: Paper Currency Depositing and Withdrawing Path Configuration;

FIG. 8 is an explanatory view generally explaining the first configuration related to the paper currency depositing transportation in a configuration of a paper currency transportation path, and FIG. 9 is an explanatory view generally explaining a path configuration related to the paper currency withdrawing transportation in the configuration of the paper currency transportation path.

As shown in FIG. 8, the paper currency depositing path 180IN is extended from the paper currency depositing unit 120, and reaches the paper currency discriminating unit 170 via the chassis section 112. Thereafter, the paper currency depositing path 180IN is folded back by a direction converting roller 180*r* on a path downstream of the paper currency discriminating unit 170, and is extended to the paper currency storing cassettes 205 along a row of respective cassettes of the paper currency storing unit 200 disposed on the lower side of the paper currency discriminating unit 170. In the paper currency depositing path 180IN having such a path locus, a portion thereof reaching the paper currency discriminating unit 170 from the paper currency depositing unit 120 is made to be the upstream side paper currency depositing path 181, and a path on the downstream side of the path is made to be the downstream side paper currency depositing path 182. In the transportation mechanism unit 180, the downstream side paper currency depositing path 182 is formed by a first main transportation path 183 extended to the direction converting roller 180*r* by passing the paper currency discriminating unit 170, and a second main transportation path 184 reaching the paper currency storing cassette 205 of the paper currency storing unit 200 by being extended in a horizontal direction by being folded back by the direction converting roller 180*r*. Further, the transportation mechanism unit 180 deposits and transports the paper currency B cast into the paper currency depositing unit 120 along a path of the paper currency depositing path 180IN to transport and deposit to any of the paper currency storing cassettes 201 through 205 in accordance with an discriminating result of the paper currency discriminating unit 170.

The respective paper currency storing cassettes 201 through 205 included by the paper currency storing unit 200 include shunt transportation paths 201*a* through 205*a* shunted from the second main transportation path 184, and gates 201*b* through 205*b* for casting in and drawing out paper currency to and from the cassettes. The gates 201*b* through 205*b* are driven by being controlled by the control unit 300 to drive the paper currency depositing path 180IN to take in the deposited and transported paper currency B in accordance with a discriminating result of the paper currency discriminating unit 170. According to the present embodiment, the paper currency storing cassette 204 serves as a recovery cassette of a reject paper currency of a broken paper currency or the like, and therefore, the deposited and transported paper currency B is deposited to either of the paper currency storing cassettes 201 through 203 and the paper currency storing cassette 205. A description will be given later of rejection at a depositing and transporting procedure. Further, the paper currency storing cassette 204 may be configured to laminate storing portions of paper currency in two up and down stages, and an upper storing portion may be configured to be used as a temporary storing portion for temporarily storing the paper currency.

As shown in FIG. 9, the paper currency withdrawing path 180OUT is extended from the paper currency storing cassette 205 of the paper currency storing unit 200 to reach the direction converting roller 180*r*, and folded back by the roller to reach the paper currency discriminating unit 170. In the paper currency withdrawing path 180OUT, a path after the paper currency discriminating unit 170 is made to be the downstream side paper currency withdrawing path 186. Further, the transportation mechanism unit 180 folds back a path of the downstream side paper currency withdrawing path 186 twice between the first main transportation path 183 and the second main transportation path 184 described already, shares a partial path portion of the second main transportation path 184, thereafter, configures a path adopting a rising path, and is extended to the paper currency withdrawing unit 140 via the chassis section 112. The paper currency withdrawing path 180OUT having such a path locus makes a portion thereof reaching the paper currency discriminating unit 170 from the paper currency storing cassette 205 of the paper currency storing unit 200 as an upstream side paper currency withdrawing path 185, and makes a path on a downstream side of the path having a fold back portion described above as the downstream side paper currency withdrawing path 186. The transportation mechanism unit 180 forms the upstream side paper currency withdrawing path 185 by the second main transportation path 184 and the first main transportation path 183 described already. The transportation mechanism unit 180 withdraws to transport the paper currency B drawn out from the paper currency storing cassettes 201 through 205 of the paper currency storing unit 200 by the shunt transportation paths 201*a* through 205*a* and the gates 201*b* through 205*b* to the paper currency withdrawing unit 140 along the path of the paper currency withdrawing path 180OUT described above. In carrying out the withdrawing transportation, the transportation mechanism unit 180 uses the first main transportation path 183 and the second main transportation path 184 commonly with the depositing transportation, and therefore, the transportation mechanism unit 180 carries out withdrawing transportation of the paper currency B in the paper currency withdrawing path 180OUT by reversing the paper currency transportation direction (reverse rotation control of prescribed drive motor 189) under the control of the control unit 300. That is, the transport mechanism unit 180 transports the paper currency B in two directions in the first main transportation path 183 and the second main transportation path 184. In carrying out the depositing and withdrawing transportation, the transportation mechanism unit 180 includes plural transportation drive rollers/driver roller pairs and plural drive motors 189, and plural detection sensors 188 at pertinent portions of the respective paths. The respective detection sensors 188 detect a situation of passing the paper currency B at sensor installing locations, and output detection results to the control unit 300. The control unit 300 receives a detection signal of the detection sensor 188 and the discriminating result of the paper currency discriminating unit 170, and carries out the depositing and withdrawing paper currency transportation control described above via a control of the drive motor 189 and the gate 201*b*.

Figure 10:
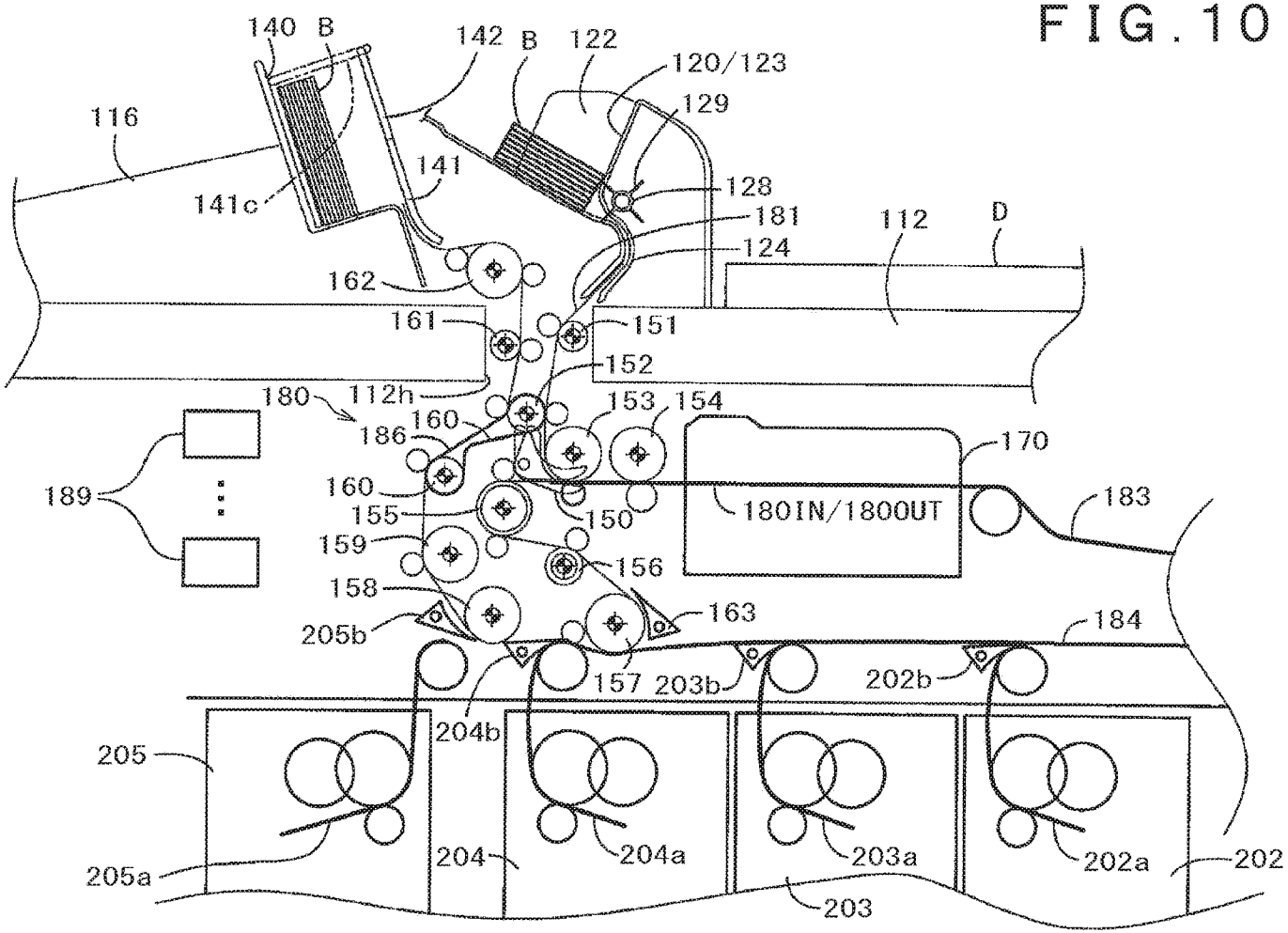
FIG. 10 is an explanatory view generally showing a behavior of a roller arrangement in an upstream side paper currency depositing path 181 and a downstream side paper currency withdrawing path 186 and a behavior of depositing and withdrawing path formation in accordance therewith.

E: Roller Configurations of Paper Currency Depositing and Withdrawing Paths;

FIG. 10 is an explanatory view generally showing a behavior of roller arrangements of the upstream side paper currency depositing path 181 and the downstream side paper currency withdrawing path 186 and the behavior of forming the paper currency depositing and withdrawing paths in accordance therewith.

As illustrated, the transportation mechanism unit 180 includes a first through a fourth drive rollers 151 through 154 along a path of the upstream side paper currency depositing path 181 extended from the paper currency depositing unit 120 to the paper currency discriminating unit 170. The respective drive rollers pair with driven rollers facing each other, and deposits and transports the paper currency B pinched between the rollers along the upstream side paper currency depositing path 181. The first drive roller 151 is related to paper currency depositing and transporting in the upstream side paper currency depositing path 181 at the downstream side of the feeding path portion 124 connecting the paper currency depositing unit 120 and the upstream side paper currency depositing path 181. Further, the first driver roller 151 is disposed in a hole of a through hole 112*h* of the chassis section 112.

The upstream side paper currency depositing path 181 is extended in a substantially vertical lower direction from the paper currency depositing unit 120 via the first driver roller 151 and the second drive roller 152 in the through hole 112*h*, folded back in a horizontal direction at the third drive roller 153, and is connected to the first main transportation path 183 at the paper currency discriminating unit 170. A gate 150 is arranged at a surrounding of the third drive roller 153. The gate 150 is driven by being controlled by the control unit 300, and is switched to the paper currency transportation along the upstream side paper currency depositing path 181 in the paper currency depositing transportation. Further, the gate 150 is switched to the paper currency transportation along the downstream side paper currency withdrawing path 186 in the paper currency withdrawing transportation. Further, the gate 150 is switched to the paper currency transportation along the downstream side paper currency withdrawing path 186 in the paper currency withdrawing transportation. The transportation mechanism unit 180 drives the respective drive rollers described above by pertinent motors of plural drive motors 189. The same goes with drive motors in the downstream side paper currency withdrawing path 186 described later.

Other than the above, the transportation mechanism unit 180 includes a fifth through a twelfth drive rollers 155 through 162 in addition to the fourth drive roller 154 and the third drive roller 153 along a path of the downstream side paper currency withdrawing path 186 extended from the paper currency discriminating unit 170 to the paper currency withdrawing unit 140 by a fold back path as described above. A tenth drive roller 160 is transmitted with a drive force of the second drive roller 152 by an endless belt 160*b* hung from the second drive roller 152 and driven along with the second drive roller 152. Also in the drive rollers described above of the downstream side paper currency withdrawing path 186, the paper currency B is withdrawn and transmitted along the downstream side withdrawing paths 160 along with driven rollers facing each other. An eleventh roller 161 is related to paper currency withdrawing transportation at the downstream side paper currency withdrawing path 186, and is disposed in the hole of the through hole 112*h* of the chassis section 112 similar to the first drive roller 151. The paper currency handling device 100 includes the first drive roller 151 and the eleventh drive roller 161 to arrange at different heights in the through hole 112*h*.

The downstream side paper currency withdrawing path 186 is extended substantially horizontally from the paper currency discriminating unit 170 via the fourth drive roller 154 and the third drive roller 153 after being connected to the first main transportation path 183 at the paper currency discriminating unit 170. Thereafter, the downstream side paper currency withdrawing path 186 is skewedly folded back to return to a side of the paper currency discriminating unit 170 by the fifth drive roller 155 (first fold back), and reaches the seventh drive roller 157 via the sixth drive roller 156. Further, the downstream side paper currency withdrawing path 186 is folded back (second fold back) again at the seventh drive roller 157 and is extended in a horizontal direction, and shares a path the lowermost path after the second fold back on one end side, specifically, a path between the seventh drive roller 157 and the eighth drive roller 158, with a partial path of the second main transportation paths 184 in the upstream side paper currency withdrawing path 185 (refer to FIG. 9). The downstream side paper currency withdrawing path 186 changes a path direction of the eighth drive roller 158 to a skewedly upper direction, rises substantially vertically between a ninth drive roller 159 and a tenth drive roller 160 and reaches the second drive roller 152. Thereafter, the downstream side paper currency withdrawing path 186 reaches the paper currency withdrawing unit 140 via the eleventh drive roller 161 and the twelfth drive roller 162 in the through hole 112*h*. That is, the transportation mechanism unit 180 includes the upstream side paper currency depositing path 181 and the downstream side paper currency withdrawing path 186 opposedly to each other in the through hole 112*h*, relates the second drive roller 152 related to the paper currency depositing transportation at the upstream side paper currency depositing path 181 also to the paper currency withdrawing transportation at the downstream side paper currency withdrawing path 186, and the second drive roller 152 is used to be shared by the paper currency depositing transportation and the paper currency withdrawing transportation. Further, the second drive roller 152 is disposed between the upstream side paper currency depositing path 181 and the downstream side paper currency withdrawing path 186 opposedly to each other, and therefore, the paper currency B is transported in the paper currency depositing transportation direction at the upstream side paper currency depositing path 181, and at the downstream side paper currency depositing path 186, the paper currency B is transported in the paper currency withdrawing transportation direction by being driven to rotate in the same direction.

The paper currency withdrawing transportation of the paper currency B drawn out from the cassette of the paper currency storing unit 200 is carried out by reversing the transportation direction of the paper currency B at a partial path shared after the second fold back on the bottom end side of the downstream side paper currency withdrawing path 186 by a situation of passing the paper currency B to the second main transportation path 184 and the first main transportation path 183 included in the upstream side paper currency withdrawing path 185 in the upstream side paper currency withdrawing path 185 from the paper currency storing unit 200, and a situation of passing the paper currency B through the downstream side paper currency withdrawing path 186 after passing the upstream side paper currency withdrawing path 185. An explanation will be given of the point as follows.

Figure 11:
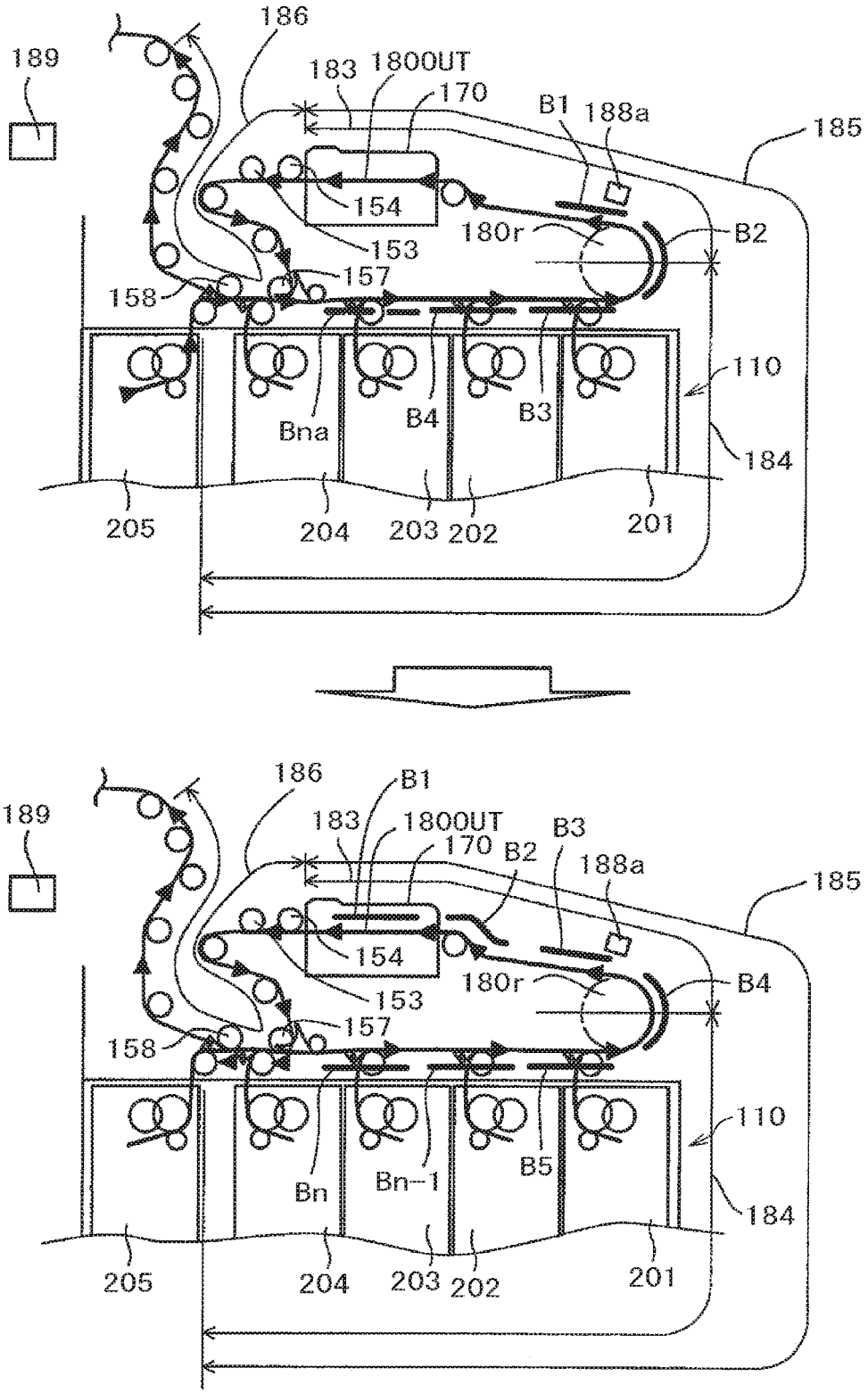
FIG. 11 is an explanatory view showing a behavior of a withdrawing transportation of the paper currency B and a behavior of reversing a transportation direction in a paper currency withdrawing path 180OUT.

F: Paper Currency Withdrawing Transportation Control;

FIG. 11 is an explanatory view showing a behavior of paper currency withdrawing transportation of the paper currency B and a behavior of reversing the transportation direction in the paper currency withdrawing path 186OUT. Further, although, in FIG. 11, the paper currency B in a transportation procedure is shown by being laminated on the transportation path, the paper currency does not correspond to an actual path length or paper currency length, but a behavior of the transportation path and the paper currency transportation is generally shown.

As shown at an upper stage of FIG. 11, under a situation in which, for example, na sheets of paper currency B (paper currency B1 through Bna) drawn out from the paper currency storing cassettes 205 are brought into a transportation procedure in the paper currency withdrawing path 180OUT, the paper currency B1 which is drawn and transported to the paper currency withdrawing path 180OUT at first does not reach the discrimination unit 170 in the first transportation path 183 of the upstream side paper currency withdrawing path 185. In the state, respective drive rollers (not illustrated) included in the first main transportation path 183, and respective drive rollers (not illustrated) in the second main transportation path 184 including the seventh drive roller 157 and the eighth drive roller 188 are driven to rotate in the withdrawing transportation direction continuously since the transportation of the first paper currency B1 even at any drive rollers. Further, the fourth drive roller 154 and respective drive rollers on the downstream side included in the downstream side paper currency withdrawing path 186 are driven to rotate in the paper currency withdrawing transportation direction continuously since the first paper currency B1 has been transported except the seventh drive roller 157 and the eighth drive roller 158. At this occasion, the drive motors 189 for driving respective drive rollers are controlled to drive to rotate reversely by the control unit 300. Further, at the time point, not a single sheet of the paper currency B is transported at the downstream side paper currency withdrawing path 186, and therefore, the respective drive rollers at the downstream side paper currency withdrawing path 186 except the seventh drive roller 157 and the eighth drive roller 158 may be stopped.

When the paper currency drawn out from the paper currency storing cassettes 205 and withdrawing transportation of the drawn out paper currency are progressed, as shown in a lower stage of FIG. 11, the first paper currency B1 arrives at the paper currency discriminating unit 170, in this state, n sheets of the paper currency B are brought into a transportation procedure at the upstream side paper currency withdrawing path 185 of the paper currency withdrawing path 180OUT, and the final paper currency Bn is already withdrawn and transported from a range of receiving a withdrawing drive force of the seventh drive roller 157 and the eighth drive roller 158. Then, a prescribed number of sheets of the paper currency B brought into a withdrawing transportation procedure reach the first main transportation path 183 from the second main transportation path 184, and therefore, the control unit 300 controls to drive only the seventh drive roller 157 and the eighth drive roller 158 related to the paper currency transportation at a fold back path at the lowest stage of the downstream side paper currency withdrawing path 186 such that a direction of transporting the paper currency B is reversed. Concerning the drive motors 189 of the two drive rollers, the drive motors 189 is switched to be controlled to drive in a regular rotation by the control unit 300. By reversing the transportation direction, all of the drive rollers included in the downstream side paper currency withdrawing path 186 starting from the fourth drive roller 154 are driven to rotate in the withdrawing transportation direction. Thereby, the paper currency B which is passed through the paper currency discriminating unit 170 is withdrawn and transported on the downstream side paper currency withdrawing path 186 and is withdrawn to the paper currency withdrawing unit 140 successively from the first paper currency B1 through the final paper currency Bn. Further, when the final paper currency Bn is withdrawn and transported from a range of receiving the transportation driving force of the eighth drive roller 158 after having passed the downstream side paper currency withdrawing path 186, the control unit 300 controls to drive the seventh drive roller 157 and the eighth drive roller 158 such that the transportation direction of the paper currency B is reversed and returned to the withdrawing transportation direction in preparation for next n sheets of the paper currency B. The number of sheets of the paper currency until the final paper currency Bn and the number of sheets of the paper currency reaching the first main transportation path 183 from the second main transportation path 184 are determined by a path length and the paper currency length of the upstream side paper currency withdrawing path 185 including the first main transportation path 183 and the second main transportation path 184 and previously set as prescribed number of sheets. Further, in a state shown in the upper stage of FIG. 11, in a case where respective drive rollers of the downstream side paper currency withdrawing path 186 except the seventh drive roller 157 and the eighth drive roller 158 are stopped, the respective drive rollers may be driven in the paper currency withdrawing transportation direction at a time point at which the first paper currency B1 reaches the paper currency recognition unit 170.

In the withdrawing transportation described above, the paper currency B drawn out from the paper currency storing cassette 203 on a side of the direction converting roller 180*r* or the paper currency storing cassettes 201 through 202 does (do) not receive the transportation drive force of the seventh drive roller 157 and the eighth drive rollers 158 in the withdrawing transportation at the second main transportation path 184 naturally when the paper currency B is drawn out from the cassette. Therefore, when the paper currency is withdrawn only from the paper currency storing cassettes 201 through 203, the control unit 300 controls to rotate the respective drive rollers of the upstream side paper currency withdrawing path 185 and the downstream side paper currency withdrawing path 186 to a side of the withdrawing transportation direction including the seventh drive roller 157 and the eighth drive roller 158.

Figure 12:
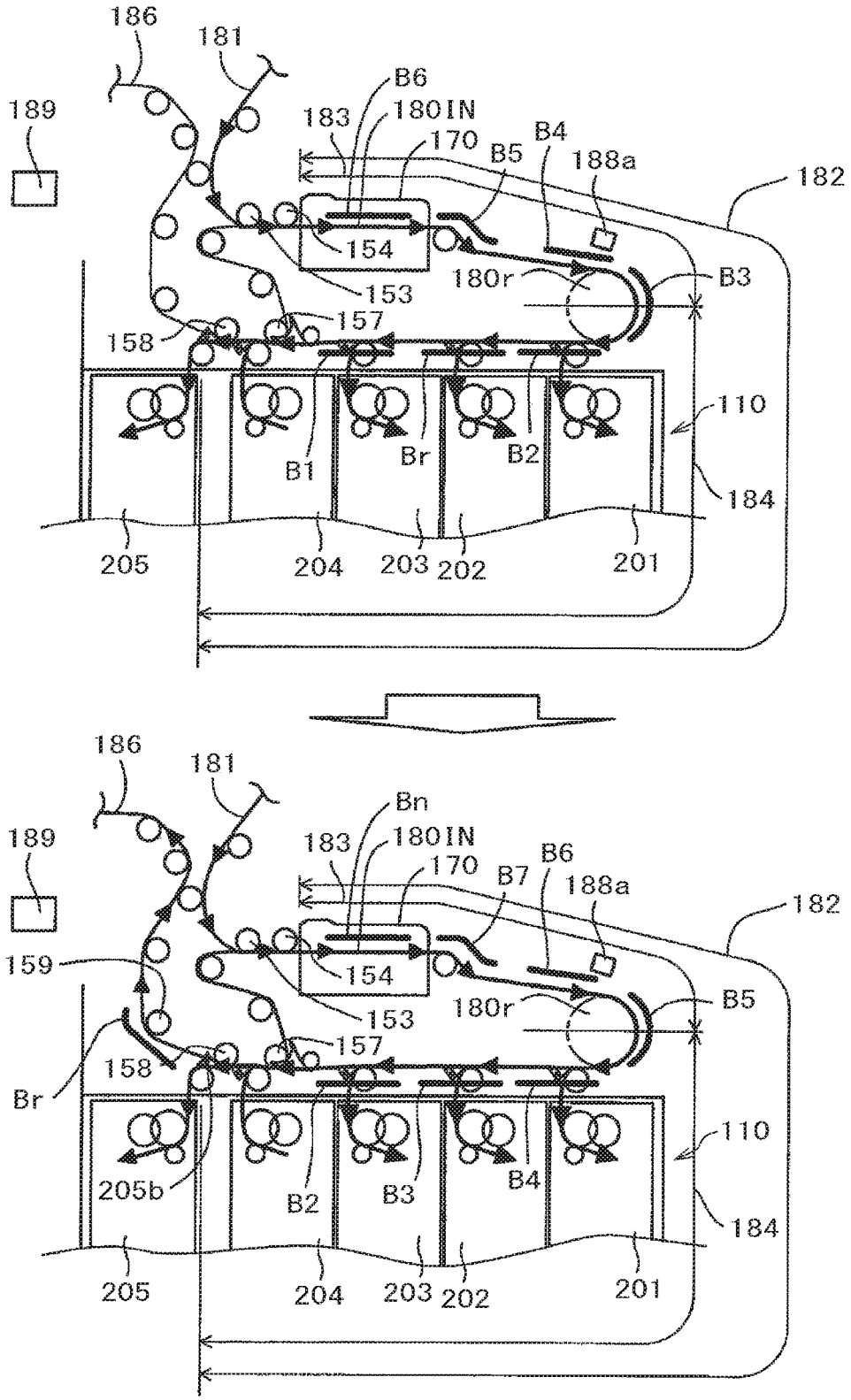
FIG. 12 is an explanatory view showing a behavior of depositing transportation of the paper currency B and a behavior of withdrawing transportation of a reject paper currency in a paper currency depositing path 180IN.

G: Reject Transportation Control in Depositing;

FIG. 12 is an explanatory view showing a behavior of depositing transportation of the paper currency B in the paper currency depositing path 180IN and a behavior of withdrawing transportation of a reject paper currency. Further, even in FIG. 12, similar to FIG. 11, the paper currency B in the transportation procedure is shown by laminating the paper currency B on the transportation path similar to FIG. 11, FIG. 12 does not correspond to an actual path length or paper currency length, but a transportation path and a behavior of the transportation are generally shown.

As shown at an upper stage of FIG. 12, in a case where plural sheets of the paper currency B are withdrawn and transported at the paper currency withdrawing path 180IN, under a situation where a reject paper currency Br (reimbursed paper currency) having a flaw, a breakage or the like is deposited, respective pieces of the reject paper currency Br and the paper currency B2 through Bn successive thereto are under a state of depositing transportation in the downstream side deposit path 182. That is, in this state, all of the drive rollers included in the upstream side paper currency depositing path 181 and the paper currency depositing path 180IN the downstream side paper currency depositing path 182 are driven to rotate toward a depositing transportation direction continuously from when the first paper currency is transported. Further, as shown in a lower stage of FIG. 12, when the reject paper currency Br arrives at the seventh drive roller 157, the control unit 300 switches the gate 205*b* on the downstream side of the eighth drive roller 158 to a side of the downstream side paper currency withdrawing path 186, and starts to drive the ninth drive roller 159 included in the downstream side paper currency withdrawing path 186 and drive rollers after the ninth drive roller on the downstream side to the withdrawing transportation side. At this occasion, concerning the drive rollers included in the upstream side paper currency depositing path 181, the control unit 300 drives the drive rollers including the third drive roller 153 and the fourth drive roller 154 continuously to a side of the depositing transportation. Thereby, the reject paper currency Br is transported along a later half path of the downstream side paper currency withdrawing path 186, deposited to the paper currency depositing unit 140, and the depositing transportation of the paper currency is continued in parallel with withdrawing of the reject paper currency. Further, the paper currency B1 and the paper currency B2 through Bn deposited after the reject paper currency Br in the drawing deposited before the reject paper currency Br are transported and stored to the paper currency storing cassettes 201 through 203 and the paper currency storing cassette 205 in accordance with the paper currency kind. Further, the control unit 300 calculates a depositing and transporting position of the paper currency which is regarded as the reject paper currency Br by an discriminating signal from the paper currency discriminating unit 170 from a time period elapsed from inputting the recognition signal from the paper currency discriminating unit 170, and carries out gate switching or drive roller control as described already.

Figure 13:
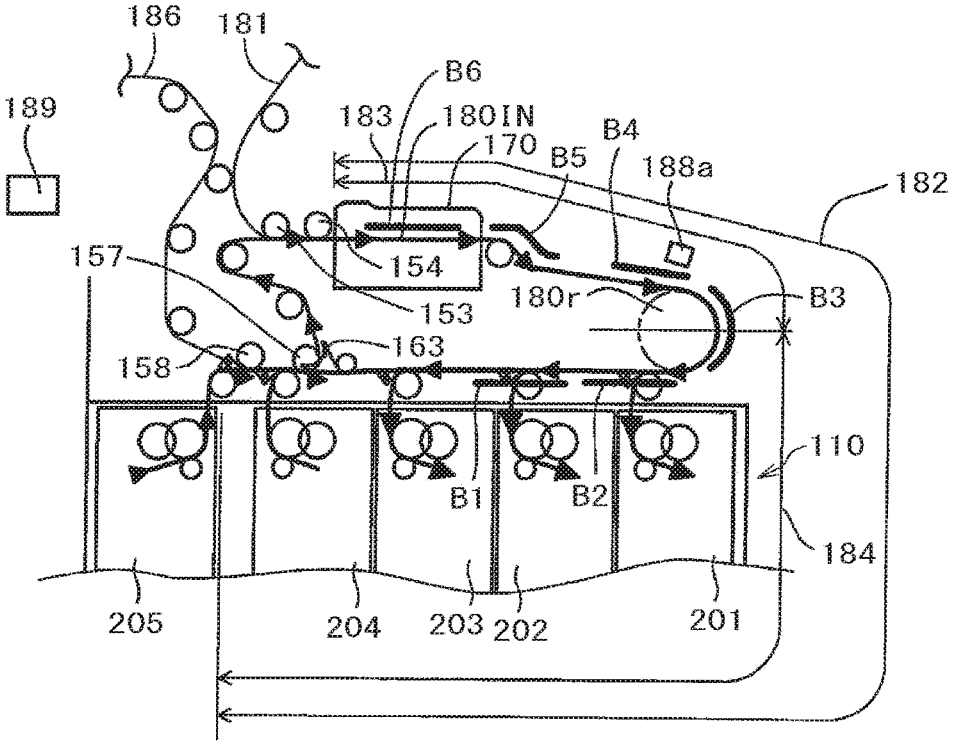
FIG. 13 is an explanatory view showing a behavior of filling and transporting the paper currency to a cassette by using both of the downstream side paper currency withdrawing path 186 and a downstream side paper currency depositing path 182.

H: Paper Currency Filling and Transporting Control;

FIG. 13 is an explanatory view showing a behavior of paper currency filling transportation to a cassette by using both of the downstream side paper currency depositing path 182 and the downstream side paper currency withdrawing path 186. Further, also in FIG. 13, similarly to FIG. 11, the paper currency B in a transportation procedure is shown by laminating on a transportation path, FIG. 13 does not correspond to an actual path length or an actual paper currency length, but a behavior of a transportation path and paper currency transportation is generally shown.

According the paper currency handling device 100 of the present embodiment, the paper currency storing cassette 205 nearest to the vault door 113 is made to be switchable and mountable for filling the paper currency to other cassette. For example, when the paper currency withdrawing from the paper currency storing cassettes 201 through 203 starting from the paper currency storing cassette 205 is progressed, the paper currency stored to the cassette is exhausted. In such a case, the paper currency storing cassette 205 is removed, and remounted in a state of storing filled paper currency necessary for the paper currency storing cassettes 201 through 203, and paper currency filling is carried out from the paper currency storing cassette 205. In such a paper currency filing, the control unit 300 transports the paper currency B drawn out from the paper currency storing cassette 205 to the second main transportation path 184 to the gate 163 by the eighth drive roller 158 and the seventh drive roller 157, and guides the drawn out paper currency B to the downstream side paper currency withdrawing path 186 by path switching of the gate 163. The control unit 300 carries out rotation control by rotating the drive roller included in the downstream side paper currency withdrawing path 186 reversely to that in paper currency withdrawing transportation, and therefore, the paper currency B drawn out from the paper currency storing cassette 205 reaches the paper currency discriminating unit 170 via the third drive roller 153 and the fourth drive roller 154, thereafter, is transported along the downstream side paper currency depositing path 182 of the paper currency depositing path 180IN. The control unit 300 receives the discriminating signal of the paper currency discriminating unit 170, and stores the paper currency B which is being transported on the downstream side paper currency depositing path 182 to any of the paper currency storing cassettes 201 through 203. Further, the paper currency at the paper currency storing cassette 205 is a paper currency for filling stored by a bank administration department, and therefore, it is assumed that a reject paper currency is included. Therefore, the paper currency storing cassette 204 is excluded from a filling object.

Figure 14:
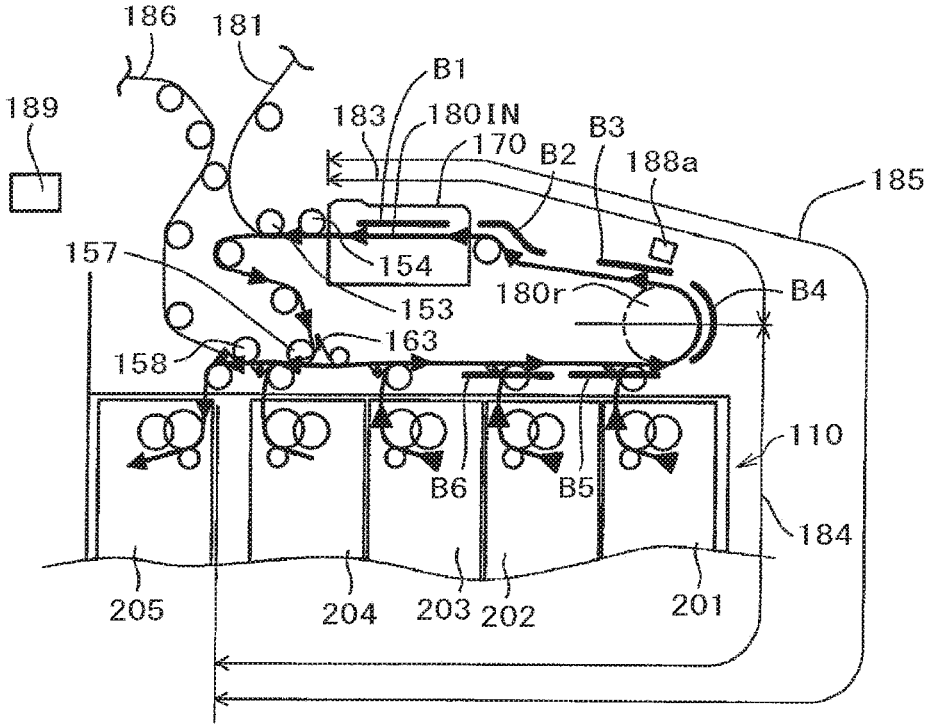
FIG. 14 is an explanatory view showing a behavior of the paper currency recovering and feeding for recovering the paper currency by using the paper currency withdrawing path 180OUT.

I: Recovery Transportation Control;

FIG. 14 is an explanatory view showing a behavior of paper currency recovery transportation for recovering the paper currency by using the paper currency withdrawing path 180OUT. Further, also in FIG. 14, similarly to FIG. 11, the paper currency B in a transportation procedure is shown by laminating the paper currency B on the transportation path, but FIG. 14 does not correspond to an actual path length or an actual paper currency length, but behavior of transportation path and paper currency transportation is generally shown.

According to the paper currency handling device 100 of the present embodiment, the paper currency storing cassette 205 nearest to the vault door 113 is switched and mounted even in recovery of the paper currency from other cassette. For example, when the paper currency withdrawing from the paper currency storing cassettes 201 through 203 is progressed, insides of the cassettes are filled with stored paper currency. In such a case, the paper currency is recovered from the paper currency storing cassettes 201 through 203 to the paper currency storing cassette 205, and the paper currency is recovered to a paper currency administration box in a bank along with the paper currency storing cassette 205. In such paper currency recovery, the control unit 300 transports the paper currency B drawn out from respective cassettes of the paper currency storing cassettes 201 through 203 to the paper currency discriminating unit 170 along the upstream side paper currency withdrawing path 185, and guides the paper currency to the gate 163 along the downstream side paper currency withdrawing path 186. At this occasion, the control unit 300 drives the respective drive rollers of the upstream side paper currency withdrawing path 185 excluding the seventh drive roller 157 and the eighth drive roller 158, and the respective drive rollers included in the downstream side paper currency withdrawing path 186 in a direction of paper currency withdrawing transportation, and concerning the gate 163 at the seventh driver roller 157, the control unit switches the gate 163 to paper currency transportation side from the downstream side paper currency withdrawing path 186 to the second main transportation path 184. Further, the control unit 300 receives a discriminating signal from the paper currency discriminating unit 170, and concerning the reject paper currency Br in the paper currency B which is being transported in a paper currency withdrawing transportation direction on the downstream side paper currency withdrawing path 186, the control unit 300 transports to store the reject paper currency Br to the paper currency storage cassette 204, and concerning a normal paper currency B, the control unit 300 transports all of the normal paper currency B to the paper currency storing cassette 205 regardless of the money kind. When the paper currency storing cassette 205 is filled with the paper currency, the cassette is removed, and stored paper currency is recovered.

The paper currency handling device 100 of the present embodiment having a configuration explained above accommodates the paper currency discriminating unit 170 and the paper currency storing cassette 204 excluding the paper currency depositing unit 120 and the paper currency withdrawing unit 140 to the chassis section 112 of the vault 110, and thereafter, achieves depositing transportation to the paper currency storing portion passing the chassis section 112 and the withdrawing transportation from the paper currency storing unit 200. Thereby, the paper currency handling device 100 of the present embodiment ensures security of the paper currency B stored in the paper currency storing unit 200. Thereafter, the paper currency handling device 100 of the present embodiment makes the vane 129 of the impeller 128 contact to the paper currency B held at the paper currency depositing unit 120 on a side of the withdrawal path unit 124 in transporting the paper currency B to the depositing path unit 124 connecting the paper currency depositing unit 120 and the upstream side paper currency depositing path 181. Therefore, as shown in FIG. 7, even when the paper currency B remains at the opening recess portion 121 while the paper currency is not brought into contact with the paper currency filling roller of the paper currency filling first roller 125 or the like and the front end of the paper currency is brought into contact with the outer surface of the paper currency end portion side wall 123 owing to a fold mark or paper currency bending, the paper currency B is pushed to a side of a bottom portion corner of the opening recess portion 121 at its end portion by bringing the vane 129 into contact with the paper currency B. By the pushing, the paper currency B in a stationary attitude by remaining at the opening recess portion 121 is brought into contact with either of the paper currency feeding first roller 125 and the paper currency feeding second roller 126 or both of them. Therefore, according to the paper currency handling device 100 of the present embodiment, the paper currency B remaining at the opening recess portion 121 can firmly be fed to the feeding path portion 124, and therefore, the upstream side paper currency depositing path 181 connecting with the feeding path portion 124, and an ability of feeding the paper currency B from the feed depositing unit 120 is improved.

The paper currency handling device 100 of the present embodiment is made to be as follows when the downstream side paper currency withdrawing path 186 reaching the paper currency withdrawing unit 140 by passing the chassis section 112 from the path upstream side of the first main path 183 including the paper currency discriminating unit 170. First, at the chassis section 112 of the present embodiment, the paper currency discriminating unit 170 and the paper currency storing unit 200 are arranged on an upper side and on a lower side. Further, as shown in FIG. 10, according to the paper currency handling device 100 of the present embodiment, the downstream side paper currency withdrawing path 186 is formed via plural fold back portions between the first main transportation path 183 passing the paper currency discriminating unit 170, and the second main transportation path 184 reaching the paper currency storing unit 200 by being folded back from the path downstream side of the first main transportation path 183, and carries out transportation (paper currency withdrawing transportation) of the path downstream side of the paper currency discriminating unit 170 at the downstream side paper currency withdrawing path 186. Therefore, according to the paper currency handling device 100 of the present embodiment, therefore, according to the paper currency handling device 100 of the present embodiment, at least an apparatus height dimension of the paper currency handling device 100 can be shortened by an amount of including plural fold back paths in the downstream side withdrawal path 186, and a path length of the downstream side paper currency withdrawing path 186 can be ensured. A height of installing the paper currency withdrawing unit 120 can be made low by shortening the apparatus height, and therefore, the window clerk M (refer to FIG. 2) can execute casting of the paper currency B to the paper currency depositing unit 120 by a small up and down motion of the arm, and therefore, the physical burden of the clerk can be alleviated.

As shown in FIG. 7, the paper currency handling device 100 of the present embodiment drives the impeller 128 such that the vane 129 is brought into contact with the paper currency B from an upper side over to a lower side of paper currency pile when the vane 129 is brought into contact with the paper currency B which has been held at the opening recess portion 121. Therefore, according to the paper currency handling device 100 of the present embodiment, the paper currency B remaining at the opening recess portion 121 can be pushed to the side of the bottom portion corner of the opening recess portion further firmly even a single sheet of the paper currency B, and therefore, the ability of feeding the paper currency B from the paper currency depositing unit 120 can further be improved.

According to the paper currency handling device 100 of the present embodiment, the paper currency depositing unit 120 is disposed on a side of the customer K by arranging the paper currency depositing unit 120 to a side of the paper currency discriminating unit 170 more than the paper currency withdrawing unit 140 (refer to FIG. 2). Therefore, according to the paper currency handling device 100 of the present embodiment, when the window clerk M facing the customer K casts in a paper currency to the paper currency depositing unit 120, the grasped paper currency B can directly be cast to the paper currency depositing unit 120, and therefore, the paper currency casting motion cab be simplified. Further specifically, the window clerk M can directly cast the paper currency B to the paper currency depositing unit 120 from a paper currency mounting portion by grasping the paper currency B (refer to FIG. 3) mounted on the customer receiving table D by the customer K. Other than the above, there is a case where the window clerk M recasts the paper currency B rejected to the paper currency withdrawing unit 140 from the paper currency withdrawing unit 140 to the paper currency depositing unit 120, in depositing transportation, or casts paper currency for counting the paper currency from a side of the paper currency withdrawing unit 140 to the paper currency depositing unit 120 in counting the paper currency in an ordinary operation. The paper currency handling device 100 of the present embodiment extends a wall portion 141 between the paper currency withdrawing unit 140 and the paper currency depositing unit 120 only to an opening upper end of the paper currency depositing unit 120, and also concerning the lid 141*c* provided at the wall portion 141, a width thereof is narrowed. Therefore, recasting the paper currency or counting the paper currency described above can easily be carried out. In addition thereto, the paper currency can be recast from the paper currency withdrawing unit 140 to the paper currency depositing unit 120 via an interval to the lid 141*c* at an upper end or the wall portion 141, and therefore, a degree of freedoms of casting the paper currency from a side of the paper currency withdrawing unit 140 to the paper currency depositing unit 120 is improved. The paper currency casting from the side of the paper currency withdrawing unit 140 to the paper currency depositing unit 120 can be carried out by avoiding the lid 141*c* to an upper side or a lower side of the drawing in FIG. 2, the width of the lid 141*c* is narrowed, and therefore, the paper currency casting avoiding the lid 141*c* is facilitated.

According to the paper currency handling device 200 of the present embodiment, the wall portion 141 on the side of the paper currency depositing unit 120 at the paper currency withdrawing unit 140 is extended only to an opening upper end of the paper currency depositing unit 120 after directly arranging the paper currency depositing unit 120 and the paper currency withdrawing unit 140 contiguously, and also concerning the lid 141*c* provided at the wall portion 141, its width is narrowed. Thereby, there is also the following advantage. First, the paper currency depositing unit 120 is arranged on a side of the paper currency discriminating unit 170 and is disposed on the side of the customer K, and therefore, a paper currency casting situation at the paper currency depositing unit 120 can directly be recognized for the customer K disposed on the side of the paper currency depositing unit 120. In addition thereto, the wall portion 141 extended only to the opening upper end of the paper currency depositing unit 140, and the lid 141*c* having a narrow width arranged with a prescribed interval can make the customer K disposed on a side of the paper currency depositing unit 120 directly recognize visually, a normal paper currency withdrawing situation at the paper currency withdrawing unit 140 and also a situation of depositing a reject paper currency. Therefore, according to the paper currency handling device 100 of the present embodiment, an easy feeling for handling the paper currency can be provided to the customer K present at the paper currency depositing and withdrawing.

According to the paper currency handling device 100 of the present embodiment, as shown in FIG. 7, a paper currency is held at the paper currency depositing unit 120 by the opening recess portion 121 an upper side end of which is opened, and the vane 129 is brought into contact with the paper currency by the impeller 128 at the bottom portion of the opening recess portion 121. Therefore, according to the paper currency handling device 100 of the present embodiment, casing of the paper currency B by the window clerk M to the paper currency depositing unit 120 can be simplified, and the vane 129 can firmly be brought into contact with the paper currency regardless of large or small of a number of sheets of casting the paper currency.

According to the paper currency handling device 100 of the present embodiment, in forming the downstream side paper currency withdrawing path 186 reaching the paper currency withdrawing unit 140 from the paper currency discriminating unit 170, as shown in FIG. 10, a fold back path on one end side of plural fold back paths is shared by a partial path of the second main transportation path 184. Therefore, according to the paper currency handling device 100 of the present embodiment, an apparatus height can further be shortened by an amount of sharing the path. Furthermore, the paper currency handling device 100 of the present embodiment enables the paper currency transportation in two directions by controlling to drive the seventh drive roller 157 and the eighth drive roller 158 regularly and reversely at the shared actual path. Thereby, according to the paper currency handling device 100 of the present embodiment, the withdrawing transportation from the respective cassettes of the paper currency storing unit 200 can be carried out without hindrance.

The paper currency handling device 100 of the present embodiment carries out withdrawing transportation at the paper currency withdrawing path 180OUT reaching the paper currency withdrawing unit 140 from the paper currency storing unit 200 as follows. First, the paper currency handling device 100 draws out the paper currency B from the paper currency storing cassettes 201 through 205 of the paper currency storing unit 200 to the second main transportation path 184, and withdraws and transports the paper currency B by the second main transportation path 184. When the paper currency withdrawing and transportation are repeated, and a prescribed number of sheets of the paper currency B in n sheets of the paper currency B withdrawn and transported on the second main transportation path 184 reach the first main transportation path 183 from the second main transportation path 184 (refer to a lower stage of FIG. 11), a transportation direction at the partial path shared by the downstream side paper currency withdrawing path 186 and the second main transportation path 184 is reversed by making a direction of rotating the seventh drive roller 157 and the eighth drive roller 158 a direction reverse to that in withdrawing transportation. Thereby, according to the paper currency handling device 100 of the present embodiment, a temporal stoppage of the withdrawing transportation in transporting the paper currency in two directions subjected to regular and reverse drive control of the driver roller is not needed, and therefore, the withdrawing transportation capability can be maintained or improved.

The paper currency handling device 100 of the present embodiment makes withdrawing transportation at the upstream side paper currency withdrawing path 181 from the paper currency depositing unit 120 to the paper currency discriminating unit 170 and the withdrawing transportation at the downstream side paper currency withdrawing path 186 from the paper currency discriminating unit 170 to the paper currency withdrawing unit 140 opposed to each other at the through hole 112*h* of the chassis section 112 where the two paths pass (refer to FIG. 10), thereafter, and uses the second driver roller 152 subjected to depositing transportation at the upstream side paper currency depositing path 181 to share as a drive roller subjected to the withdrawing transportation at the downstream side paper currency withdrawing path 186. Therefore, according to the paper currency handling device 100 of the present embodiment, space saving formation of a space of installing the upstream side paper currency depositing path 181 and the downstream side paper currency withdrawing path 186, and therefore, compact formation of the apparatus can be achieved.

The paper currency handling device 100 of the present embodiment arranges the first driver roller 151 related to the depositing transportation at the upstream side paper currency depositing path 181 and the eleventh drive roller 161 related to the withdrawing transportation at the downstream side paper currency withdrawing path 186 at different heights in the through hole 112*h* where the upstream side depositing path 181 and the downstream side withdrawing path 186 are opposed as shown in FIG. 10. Therefore, according to the paper currency handling device 100 of the present embodiment, the space saving formation of the space of installing the upstream side paper currency depositing path 181 and the downstream side paper currency withdrawing path 186 can further be promoted.

The present invention is not limited to embodiments, examples, or modified examples described above, but can be realized in various configurations within the range not deviated from the gist. For example, technical features of embodiments, examples and modified examples in correspondence with technical features of respective modes described in the column of summary of invention can pertinently be replaced or combined for resolving a portion or a total of the problem described above, or achieving a portion or a total of the effect described above. Further, when the technical feature is not explained as indispensable in the present specification, the technical feature can pertinently be deleted.

Figure 15:
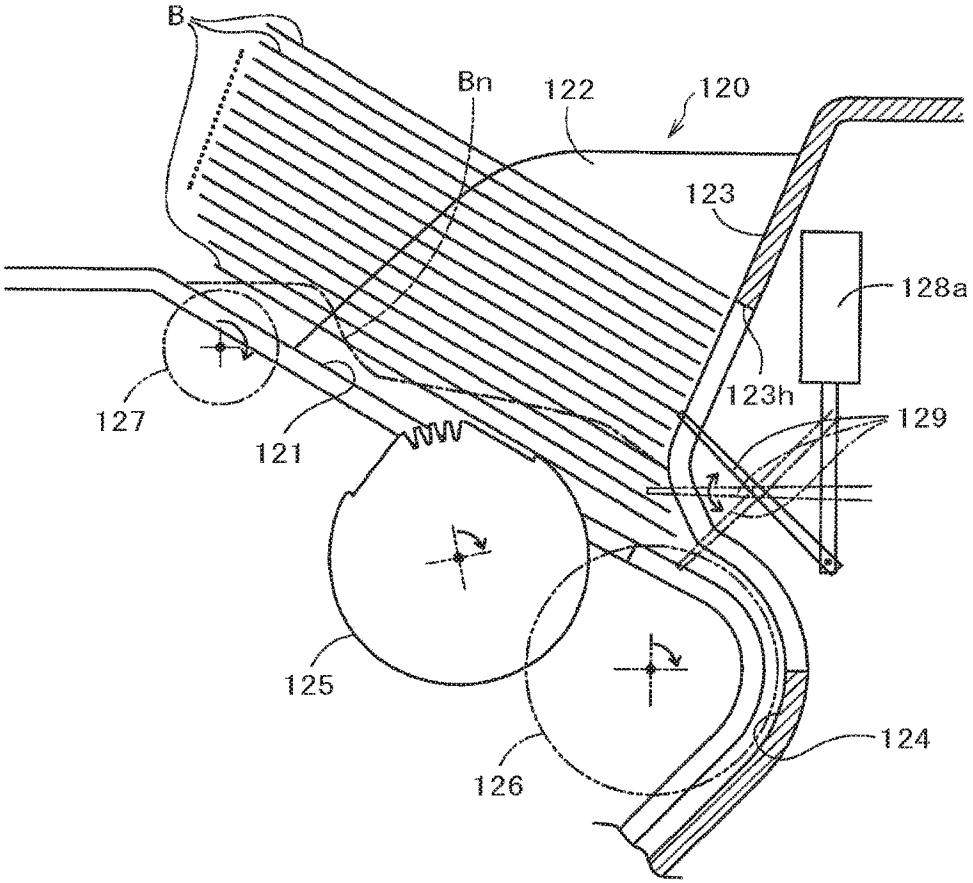
FIG. 15 is an explanatory view generally showing another embodiment of bringing a vane 129 in contact with the paper currency B.

Although in the embodiment described above, the contact of the vane 129 to the paper currency is carried out by driving to rotate the impeller 128, the present invention is not limited to the configuration. FIG. 15 is an explanatory view generally showing another embodiment of bringing the vane 129 into contact with the paper currency B. As shown in FIG. 15, the paper currency depositing unit 120 of the present embodiment rockably holds the vane 129 in an arrow mark direction of the drawing, and the vane 129 is driven to rock by an actuator 128*a*. Even in the paper currency handling device 100 including the paper currency depositing unit 120 of the present embodiment, the vane 129 is brought into contact with an end portion of the paper currency by rocking the vane 129, and therefore, the effect described already can be achieved.

According to the paper currency handling device 100 of the embodiment described above, a paper currency contact formation achieving contact of the vane 129 to the paper currency B by driving to rotate the impeller 128 having the vane 129, and a path sharing configuration of sharing the fold back path with the second main transportation path 184 after configuring the downstream side paper currency withdrawing path 186 by the fold back path, however, either of the paper currency contact configuration and the path sharing configuration may be adopted.

Figure 16:
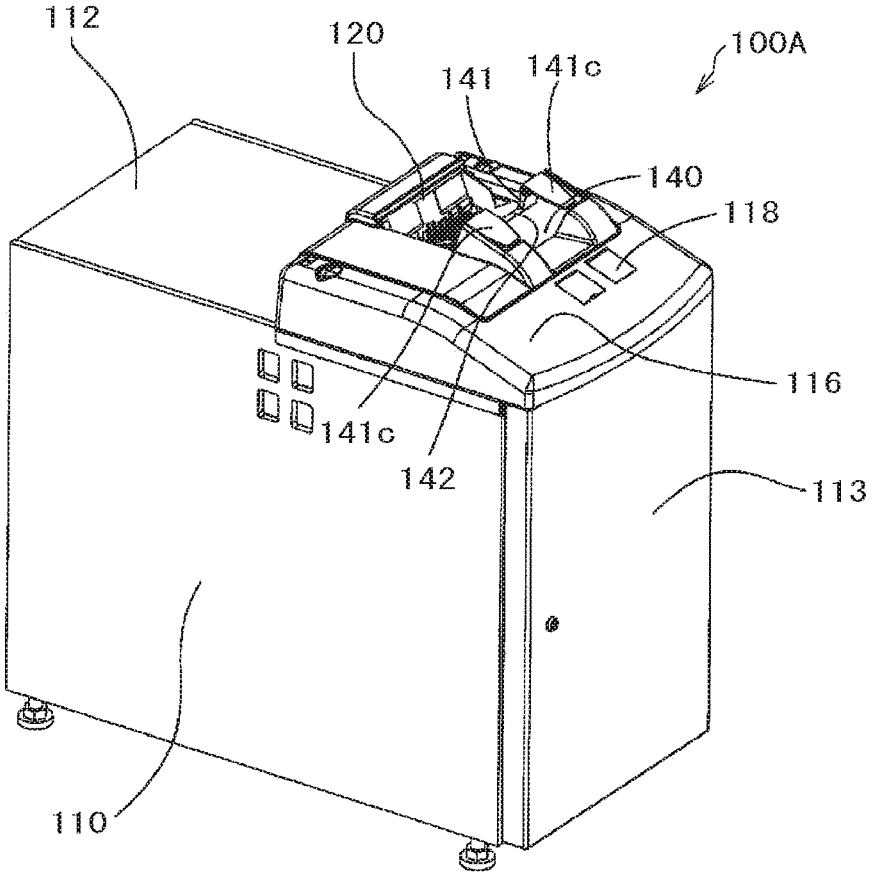
FIG. 16 is an explanatory view showing a general outlook of a paper currency handling device 100A according to another embodiment.
Figure 17:
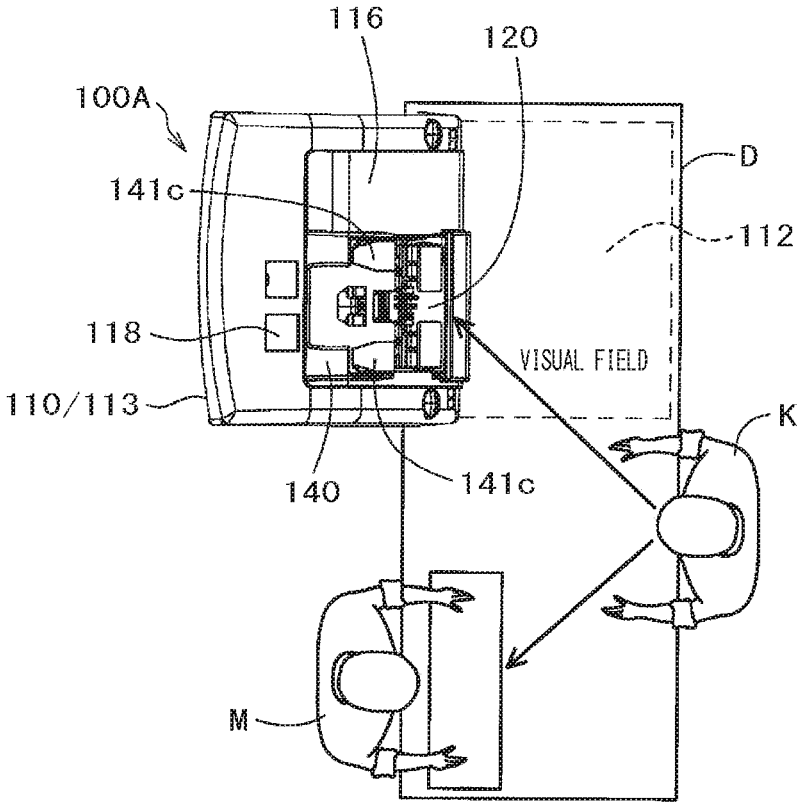
FIG. 17 is an explanatory view generally showing a positional relationship for the clerk M of the window and the customer K by viewing the paper currency handling device 100A in a plane view.
Figure 18:
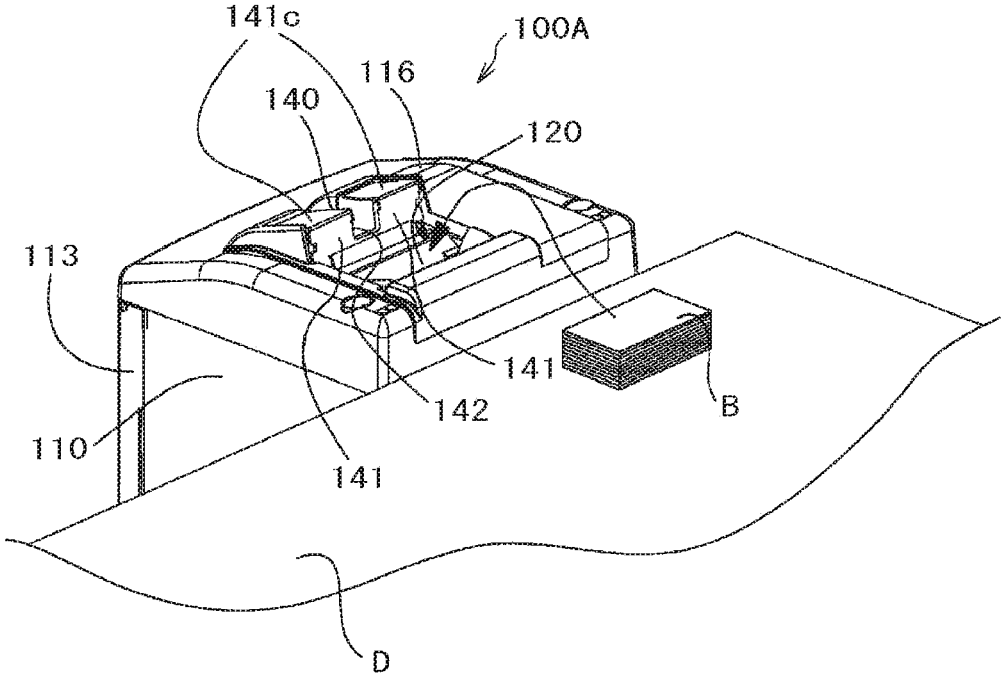
FIG. 18 is an explanatory view generally showing an upper area of the paper currency handling device 100A in a perspective view.

Next, an explanation will be given of another embodiment. FIG. 16 is an explanatory view showing a general outlook of the paper currency handling device 100A according to another embodiment, FIG. 17 is an explanatory view generally showing a positional relationship for the window clerk M and the customer K by viewing the paper currency handling device 100A in a plane view, and FIG. 18 is an explanatory view generally showing an upper area of the paper currency handling device 100A in a perspective view. According to the paper currency handling device 100A, a behavior of arranging the wall portion 141 between the paper currency depositing unit 120 and the paper currency withdrawing unit 140 differs. As illustrated, the paper currency handling device 100A of the present embodiment contiguously includes the paper currency depositing unit 120 and the paper currency withdrawing unit 140 similar to the previous paper currency handling device 100, and concerning the wall portion 141, the wall portion 141 is projected to be higher than the paper currency depositing unit 120 after covering an inner portion of the paper currency withdrawing unit 140 on a side of the paper currency depositing unit 120. Further, as shown in FIG. 18, the paper currency depositing unit 140 includes the opening 142 at an upper end edge of the wall portion 141, and includes the lids 141*c* at upper end edges on both sides of the opening 142. The opening 142 is opened to be large in a recessed shape from a center of an upper end of the wall portion 141 over to both sides thereof, and does not obstruct the eyes of the customer K when the customer K (refer to FIG. 17) interposing the customer receiving table D views the paper currency withdrawing unit 140. The lid 141*c* is made to be openable and closable to cover an opening upper end of the paper currency withdrawing unit 140, and prevents jump out of the withdrawn paper currency transported to the paper currency withdrawing unit 140.

Also in the paper currency handling device 100A of the present embodiment, similarly to the previous paper currency handling device 100, by disposing the paper currency depositing unit 120 on a side of the customer K (refer to FIG. 17), when the window clerk M facing the customer K casts a paper currency to the paper currency depositing unit 120, the grasped paper currency B can directly be cast to the paper currency depositing unit 120, and the paper currency casting motion can be simplified. More specifically, the window clerk M can directly cast the paper currency B from a paper currency mounting portion to the paper currency depositing unit 120 by grasping the paper currency B which is mounted on the customer receiving table D by the customer K (refer to FIG. 18). Other than these, according to the paper handling device 100A of the present embodiment, paper currency recasting of the paper currency described above or casting of the paper currency for counting is made to be easy to carry out by opening of the opening 142 to be large from the upper end center of the wall portion 141 to the both sides.

The paper handling device 100A of the present embodiment provides the opening 142 at the upper end of the wall portion 141 by projecting the wall portion 141 on the side of the paper currency depositing unit 120 in the paper currency withdrawing unit 140 to be higher than the paper currency depositing unit 120 after contiguously arranging the paper currency depositing unit 120 and the paper currency withdrawing unit 140 (refer to FIG. 18). Therefore, according to the paper currency handling device 100A of the present embodiment, similar to the previous paper currency handling device 100, the customer K disposed on a side of the paper currency depositing unit 120 is allowed to be able to directly recognize visually the paper currency casting situation at the paper currency depositing unit 120, and allowed to be able to directly recognize visually, an ordinary paper currency withdrawing situation or also a situation of withdrawing a deposited reject paper currency at the paper currency withdrawing unit 140 through the opening 142. Thereby, an easy feeling for paper currency handling can be given to the customer K present at paper currency depositing and withdrawing.

LIST OF REFERENCE SIGNS

100, 100A paper currency handling devices,
110 vault,
112 chassis section,
112*h* through hole,
113 vault door,
116 paper currency depositing and withdrawing mechanism unit,
118 operator panel,
120 paper currency depositing unit,
121 opening recess portion,
122 side wall,
123 paper currency end portion side wall,
123*h* opening,
124 feeding path unit,
125 paper currency feeding first roller,
125*a* paper currency feeding first auxiliary roller,
126 paper currency feeding second roller,
127 paper currency feeding third roller,
128 impeller,
128*a* actuator,
129 vane,
140 paper currency withdrawing unit,
141 wall portion,
141*c* lid,
142 opening,
150 gate,
151 through 162 first through twelfth drive rollers,
160*b* endless belt,
163 gate,
170 paper currency discriminating unit,
180 transportation mechanism unit,
180IN paper currency depositing path,
180OUT paper currency withdrawing path,
180*r* direction converting roller,
181 upstream side paper currency depositing path,
182 downstream side paper currency depositing path,
183 first main transportation path,
184 second main transportation path,
185 upstream side paper currency withdrawing path,
186 downstream side paper currency withdrawing path,
188 detection sensor,
189 drive motor,
200 paper currency storing unit,
201 through 205 paper currency storing cassettes,
201*a* through 205*a* shunt transportation paths,
201*b* through 205*b* gates,
300 control unit,
301 main control unit,

302 memory,
303 upper communication unit,
B paper currency,
M window clerk,
K customer,
D customer receiving table,
P operation terminal,
Br reject paper currency

The invention claimed is:

1. A paper currency handling device comprising:

a paper currency depositing unit that receives paper currency depositing of a paper currency;

a paper currency withdrawing unit that withdraws the paper currency;

a discriminating unit that discriminates a kind of the deposited and withdrawn paper currency;

a storing unit that stores the paper currency;

a vault having a chassis section that accommodates the storing unit and the discriminating unit and partitions the paper currency depositing unit and the paper currency withdrawing unit from the storing unit and the discriminating unit; and a transporting unit that connects the paper currency depositing unit and the paper currency withdrawing unit to the discriminating unit and the storing unit and transports the paper currency, wherein the paper currency depositing unit includes a feeding unit that connects a paper currency holding unit piling and holding the received paper currency to the transporting unit and feeds the paper currency held by the paper currency holding unit to the transporting unit, and a vane drive member that drives a vane capable of being brought into contact with the paper currency held by the paper currency holding unit, wherein in feeding the paper currency from the feeding unit, the vane is brought into contact with the paper currency held by the paper currency holding unit by driving the vane by the vane drive member, wherein the paper currency depositing unit includes the paper currency holding unit as a recess portion, an upper side of the recess portion being opened, and the paper currency depositing unit including the vane drive member at a bottom portion of the recess portion on a side of the paper currency feeding portion, and wherein the vane drive member drives the vane to bring the vane into contact with the paper currency from an upper side over to a lower side of a paper currency pile to cause the paper currency to change from a stationary attitude to being in contact with a paper currency feeding roller.

2. The paper currency handling device according to claim 1, wherein the paper currency depositing unit is arranged on a side of the discriminating unit of the paper currency withdrawing unit.

3. The paper currency handling device according to claim 1, wherein the transporting unit includes:

a main transporting unit including a first main transportation path passing the discriminating unit, and a second main transportation path reaching the storing unit by being folded back from a path downstream of the first main transportation path, and transporting the paper currency in two directions at the first main transportation path and the second main transportation path;

a first auxiliary transporting unit connected to the main transportation path by passing the chassis section from the paper currency depositing unit for transporting the paper currency from the paper currency depositing unit; and a second auxiliary transporting unit connected to the first main transportation path, reaching the paper currency withdrawing unit by passing the chassis section, and transporting the paper currency to the paper currency withdrawing unit;

wherein the second auxiliary transporting unit transports the paper currency by a path formed via a plurality of fold backs between the first main transportation path and the second main transportation path.

4. The paper currency handling device according to claim 1, wherein the chassis section is formed by a metallic steel plate and configures the vault along with a vault door made of metal.

5. A paper currency handling device comprising:

a paper currency depositing unit that receives depositing of a paper currency;

a paper currency withdrawing unit that withdraws the paper currency;

a discriminating unit that discriminates a kind of the deposited and withdrawn paper currency;

a storing unit that stores the paper currency;

a vault having a chassis section that accommodates the storing unit and the discriminating unit and partitions the paper currency depositing unit and the paper currency withdrawing unit from the storing unit and the discriminating unit; and a transporting unit that connects the paper currency depositing unit and the paper currency withdrawing unit to the discriminating unit and the storing unit, and transports the paper currency;

wherein the transporting unit includes:

a main transporting unit including a first main transportation path passing the discriminating unit, and a second main transportation path reaching the storing unit by being folded back from a path downstream of the first main transportation path, and transporting the paper currency in two directions at the first main transportation path and the second main transportation path;

a first auxiliary transporting unit connected to the first main transportation path by passing the chassis section from the paper currency depositing unit for transporting the paper currency from the paper currency depositing unit; and a second auxiliary transporting unit connected to the first main transportation path, reaching the paper currency withdrawing unit by passing the chassis section for transporting the paper currency to the paper currency withdrawing unit, wherein the second auxiliary transporting unit transports the paper currency at a path formed via a plurality of fold back paths between the first main transportation path and the second main transportation path, and wherein the second auxiliary transporting unit shares a fold back path on one end side of the plurality of fold back paths with a partial path of the second main transportation path, and enables transporting the paper currency in two directions of the shared partial path.

6. The paper currency handling device according to claim 5, wherein the second auxiliary transporting unit reverses a transportation direction at the shared partial path when a predetermined number of sheets of the paper currency drawn from the storing unit are transported and withdrawn at the second main transportation path from the storing unit reach the first main transportation path from the second main transportation path.

7. The paper currency handling device according to claim 5, wherein the first auxiliary transporting unit and the second auxiliary transporting unit oppose paths at a portion of passing the chassis section, share to use a drive unit subjected to paper currency transportation of the first auxiliary transporting unit with a drive unit subjected to paper currency transportation of the second auxiliary transporting unit.

8. The paper currency handling device according to claim 7, wherein the first auxiliary transporting unit includes a paper currency depositing side drive unit related to paper currency transportation at the passing portion;

wherein the second auxiliary transporting unit includes a paper currency withdrawing side drive unit related to a transportation at the passing portion; and wherein the paper currency depositing side drive unit and the paper currency withdrawing side drive unit are arranged at different heights at the passing portion.

* * * * *